US008367289B2

(12) United States Patent
Isono et al.

(10) Patent No.: US 8,367,289 B2
(45) Date of Patent: Feb. 5, 2013

(54) TONER

(75) Inventors: Naoya Isono, Suntou-gun (JP); Satoshi Handa, Saitama (JP); Katsuyuki Nonaka, Mishima (JP); Koji Abe, Numazu (JP); Yasuhiro Hashimoto, Mishima (JP); Akira Sugiyama, Yokohama (JP); Yuhei Terui, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 99 days.

(21) Appl. No.: 12/812,869

(22) PCT Filed: Feb. 24, 2009

(86) PCT No.: PCT/JP2009/053800

§ 371 (c)(1),
(2), (4) Date: Jul. 14, 2010

(87) PCT Pub. No.: WO2009/107829

PCT Pub. Date: Sep. 3, 2009

(65) Prior Publication Data

US 2011/0053073 A1 Mar. 3, 2011

(30) Foreign Application Priority Data

Feb. 26, 2008 (JP) ..... 2008-043773

(51) Int. Cl.
*G03G 9/08* (2006.01)

(52) U.S. Cl. ..... 430/108.3; 430/108.4; 430/110.4

(58) Field of Classification Search ..... 430/108.3, 430/108.4, 110.4
See application file for complete search history.

(56) References Cited

U.S. PATENT DOCUMENTS

| | | | | |
|---|---|---|---|---|
| 6,096,468 | A | 8/2000 | Ohno et al. | 430/110 |
| 2002/0106572 | A1 | 8/2002 | Toyama | |
| 2006/0216631 | A1* | 9/2006 | Yamazaki et al. | 430/126 |
| 2007/0212631 | A1* | 9/2007 | Abe et al. | 430/109.3 |
| 2009/0130582 | A1 | 5/2009 | Handa et al. | 430/108.3 |
| 2009/0214966 | A1* | 8/2009 | Kishida | 430/48 |

FOREIGN PATENT DOCUMENTS

| | | | |
|---|---|---|---|
| JP | 06-59498 | A * | 3/1994 |
| JP | 8-272132 | A | 10/1996 |
| JP | 9-311499 | A | 12/1997 |
| JP | 2002-296829 | A | 10/2002 |
| JP | 2007-108622 | A | 4/2007 |
| JP | 2007-148198 | A | 6/2007 |

OTHER PUBLICATIONS

Thomson-Derwent machine-assisted translation of JP 06-59498 A (pub. Mar. 1994).*
PCT International Preliminary Report on Patentability and Written Opinion of the International Searching Authority, International Application No. PCT/JP2009/053800, Mailing Date Sep. 10, 2010.
Korean Office Action dated Mar. 12, 2012 in Korean Application No. 10-2010-7021336.
Chinese Office Action dated Jul. 30, 2012 in Chinese Application No. 200980106493.4.

* cited by examiner

*Primary Examiner* — Janis L Dote
(74) *Attorney, Agent, or Firm* — Fitzpatrick, Cella, Harper & Scinto

(57) ABSTRACT

A toner is provided which is excellent in development stability in both a low-temperature, low-humidity environment and a high-temperature, high-humidity environment over a long time period. The toner includes toner particles containing at least a binder resin and a colorant, and a fatty acid metal salt. The fatty acid metal salt has a volume-based median diameter (D50s) of 0.15 μm or more and 0.65 μm or less, and the liberation ratio of the fatty acid metal salt in the toner is 1.0% or more and 25.0% or less.

11 Claims, 4 Drawing Sheets

TONER

TECHNICAL FIELD

The present invention relates to a toner to be used in an electrophotographic method, an electrostatic recording method, or a magnetic recording method, and more specifically, to a toner for developing an electrostatic image (hereinafter abbreviated as "toner") to be used in an image-recording apparatus that can be utilized in, for example, a copying machine, a printer, a facsimile, or a plotter.

BACKGROUND ART

Requests from users for electrophotography to be employed in, for example, a receiving apparatus of a copying machine, printer, or facsimile machine have become more demanding year by year in association with the development of the apparatus. The recent trend is as follows: the electrophotography has been strongly requested to be capable of performing printing on a large number of sheets and providing stable image quality independent of an environment in association with the expansion of the variety of environments where the electrophotography is employed owing to the expansion of markets.

In order that the above requests may be satisfied, a need for toner having high durability and capable of providing high image quality has become even higher than before, and a large number of improvements have been made with a view to solving the foregoing problems.

For example, it has been known that a fatty acid metal salt is incorporated into toner so as to be used as a cleaning assistant or an agent for preventing filming on an electrostatic latent image-bearing member. On the other hand, however, an improvement in image quality cannot be achieved because the fatty acid metal salt causes fogging or a reduction in image density. In view of the foregoing, the following has been disclosed (for example, Japanese Patent Application Laid-Open No. H08-272132): the fatty acid metal salt and a titanate compound are used in combination so that fogging may be alleviated while filming on the electrostatic latent image-bearing member and voids are alleviated.

In addition, the following has been disclosed (for example, Japanese Patent Application Laid-Open No. H09-311499 and Japanese Patent Application Laid-Open No. 2002-296829): a relationship among the particle diameter of toner particles having a certain storage modulus or the grain size distribution of the toner particles, and the particle diameters and grain size distribution of the particles of a fatty acid metal salt is specified so that image quality may be improved, and fogging and filming on an electrostatic latent image-bearing member may be alleviated.

In addition, the following has been disclosed (for example, Japanese Patent Application Laid-Open No. 2007-148198): fogging, toner scattering, and toner leakage are suppressed by incorporating additives (alumina and titanium oxide) having a specified relationship of a work function to base particles, and a fatty acid metal salt.

Further, the following has been disclosed (for example, Japanese Patent Application Laid-Open No. 2007-108622): a toner particle is coated with a fatty acid metal salt, suppressing the liberation ratio of the fatty acid metal salt so that image stability may be improved while the fatty acid metal salt can serve as an agent for inhibiting filming on an electrostatic latent image-bearing member.

Indeed, such measures have allowed fogging, toner scattering and toner leakage to be reduced while suppressing the filming of toner on an electrostatic latent image-bearing member, and high durability and high image quality stability to be obtained. However, as a result of the extensive studies conducted by the inventors of the present invention, it has been found that the particle diameter of the particles of the fatty acid metal salt to be used in the toner described in each of Japanese Patent Application Laid-Open No. H08-272132 and Japanese Patent Application Laid-Open No. H09-311499 is so large that a problem is raised in that although the fatty acid metal salt has a certain effect on initial fogging, a change in chargeability of the toner becomes large and fogging occurs when printing is performed on a large number of sheets. Additionally, it has been found that the toner described in each of Japanese Patent Application Laid-Open No. 2002-296829 and Japanese Patent Application Laid-Open No. 2007-148198 involves the following problem: under a severe environment such as a low-temperature, low-humidity environment or a high-temperature, high-humidity environment, an increase in the number of sheets on which printing is performed leads to the occurrence of fogging due to deterioration in the chargeability of the toner.

In addition, it has been found that the toner described in Japanese Patent Application Laid-Open No. 2007-108622 involves the following problem: toner particles must be coated with the fatty acid metal salt, and hence, large mechanical damage is done to toner particles in the coating step, and a development stripe is apt to occur.

Moreover, it has been found that each of the measures still involves a problem in terms of the contamination of a member in which rubbing largely occurs, such as a toner bearing member or a toner-supplying member, with toner under a low-temperature, low-humidity environment in addition to the above-mentioned problems involved in the measures. It has also been found that, particularly when printing is performed on a large number of sheets, detrimental effects on an image resulting from the filming of the toner on the member occur. At present, improvements in various characteristics have still been needed in order that stable developability independent of environments in which the toner is used can be obtained even when printing is performed on a large number of sheets, as requested in the market.

DISCLOSURE OF THE INVENTION

An object of the present invention is to provide a toner that has solved the above problems of the background art.

That is, the object of the present invention is to provide a toner excellent in durability and development stability in both a low-temperature, low-humidity environment and a high-temperature, high-humidity environment over a long time period.

The present invention relates to a toner including toner particles containing at least a binder resin and a colorant, and a fatty acid metal salt, in which the fatty acid metal salt includes particles having a volume-based median diameter (D50s) of 0.15 μm or more and 0.65 μm or less; and a liberation ratio of the fatty acid metal salt in the toner is 1.0% or more and 25.0% or less.

According to the present invention, a toner can be provided which is capable of constantly providing high-quality images irrespective of an environment even when long-term printing is performed. That is, according to the present invention, a toner can be provided having the following characteristics: the filming of the toner on, for example, a toner bearing member or a toner-supplying member can be suppressed even when printing is carried out for a long time in a low-temperature, low-humidity environment, and furthermore, fogging can be suppressed over a long time period even in a low-temperature, low-humidity environment and a high-temperature, high-humidity environment.

Further features of the present invention will become apparent from the following description of the exemplary embodiments with reference to the attached drawings.

DESCRIPTION OF REFERENCE NUMERALS

| | |
|---|---|
| 10 | latent image-bearing member |
| 11 | charge roller |
| 13 | toner container |
| 14 | toner bearing member |
| 15 | toner-supplying member |
| 16 | control blade |
| 17 | toner |
| 25 | stirring part |

BEST MODE FOR CARRYING OUT THE INVENTION

An ability to perform printing over a long time period irrespective of temperature and humidity has become an essential condition for satisfying the market needs. In view of the foregoing, the inventors of the present invention have made extensive studies with a view to obtaining the characteristic.

As a result, the inventors have found that the characteristic can be obtained by: adding a fatty acid metal salt including particles having a certain particle diameter and a certain grain size distribution; and specifying the liberation amount of the fatty acid metal salt in toner.

To be specific, the above excellent characteristic can be obtained by the following procedure: a toner containing toner particles each containing at least a binder resin, a colorant and a release agent, and a fatty acid metal salt including particles having a volume-based median diameter (D50s) of 0.15 μm or more and 0.65 μm or less, is prepared, and the liberation ratio of the fatty acid metal salt is set to be 1.0% or more and 25.0% or less.

Although a detailed reason for the foregoing is unclear, the inventors consider the reason as below.

Figure 6:
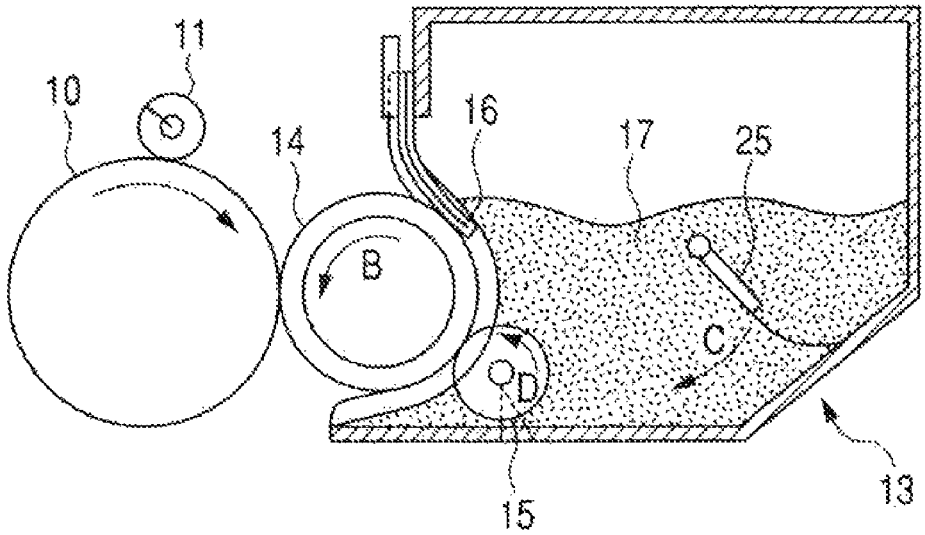
FIG. 6 is a sectional view of a process cartridge.

In a process cartridge shown in FIG. 6, mechanical damage to toner enlarges because rubbing occurs between a toner bearing member 14 and a toner-supplying member 15 or between the toner bearing member 14 and an electrostatic latent image-bearing member 10. Accordingly, the filming of the toner on the toner bearing member or the toner-supplying member tends to occur. In particular, under a low-temperature, low-humidity environment, rubbing becomes larger and damage to the toner becomes more remarkable, as a process speed increases. Further, as the number of sheets on which printing is performed increases, deterioration in the toner occurs, and filming on the members is more liable to occur. When the filming of the toner on the toner bearing member or the like occurs, a difference in charging ability arises between a filming portion and other portions, with the result that an image defect called density unevenness occurs on an image.

In view of the foregoing, the present invention adopts the following procedure: a fatty acid metal salt including particles having a smaller particle diameter than particles of a conventionally used fatty acid metal salt is incorporated into toner, and furthermore, the liberation ratio of the fatty acid metal salt from toner particles is controlled to fall within a predetermined range. It has been found that with such a procedure, the filming of the toner on the toner bearing member or the toner-supplying member can be suppressed, and deterioration in the toner can be suppressed, whereby high image quality can be obtained over a long time period. Further, it has been found that fogging due to a reduction in chargeability, which is a conventional problem occurring when a fatty acid metal salt is added, is reduced, whereby development stability can be obtained over a long time period.

The fatty acid metal salt used in the toner of the present invention includes particles having a volume-based median diameter (D50s) of 0.15 μm or more and 0.65 μm or less. Such a fine fatty acid metal salt serves as a lubricant when the toner is rubbed between a toner bearing member and a toner-supplying roller. The fatty acid metal salt serving as a lubricant exhibits the effect of alleviating damage to particles of the toner to suppress the occurrence of filming. In addition, the fatty acid metal salt can be uniformly present on the surfaces of particles of the toner because of its fine size, whereby the generation of toner charged to reverse polarity can be reduced. As a result, fogging or a reduction in image stability which has been conventionally apt to occur when a fatty acid metal salt is added, can be alleviated, and images having stably high quality can be obtained over a long time period even under a high-temperature, high-humidity environment.

When the volume-based median diameter of the fatty acid metal salt in the present invention is less than 0.15 μm, its function as a lubricant is reduced owing to the small particle diameter, with the result that it becomes difficult to obtain the effect of suppressing the filming of the toner on a toner bearing member or the like. In contrast, when the volume-based median diameter exceeds 0.65 μm, the fatty acid metal salt is apt to be present unevenly on the surfaces of toner particles, so a charge distribution arises between the toner particles, and the amount of toner with reverse polarity increases. As a result, fogging or a reduction in image stability resulting from the fatty acid metal salt is apt to occur under a high-temperature, high-humidity environment. In addition, as the particle diameter of the particles of the fatty acid metal salt increases, the liberation of the fatty acid metal salt in the toner tends to occur. In this case, when printing is performed on a large number of sheets, the fatty acid metal salt is liberated from the toner particles, so its effect of suppressing filming weakens, and detrimental effects on an image due to filming on the toner bearing member are apt to occur. The median diameter (D50s) more preferably falls within the range of 0.30 μm or more and 0.60 μm or less; the effect of the present invention can be obtained more stably in that range.

In addition, in the present invention, the liberation ratio of the fatty acid metal salt in the toner must be 1.0% or more and 25.0% or less. When the liberation ratio of the fatty acid metal salt falls within the range of 1.0% or more to 25.0% or less, a certain amount of the fatty acid metal salt is present on the surface of each toner particle even after printing on a large number of sheets, whereby the effect of the present invention is persistently exerted. When the liberation ratio is less than 1.0%, the amount of the fatty acid metal salt to be supplied to a cleaning step becomes insufficient, with the result that cleaning failure tends to occur. In contrast, when the liberation ratio exceeds 25.0%, fogging increases due to the liberation of the fatty acid metal salt. Further, in this case, when printing is performed on a large number of sheets, the liberated fatty acid metal salt is consumed, so its effect as a lubricant exhibited when the toner is rubbed, is reduced, and filming on a toner bearing member occurs in some cases. The liberation ratio more preferably falls within the range of 2.0% or more to 20.0% or less; high-quality images can be obtained more stably in that range.

The liberation ratio of the fatty acid metal salt in the present invention is found from an expression (X−Y)/X where X represents the metallic element intensity of the fatty acid metal salt in the toner measured with fluorescent X-rays, and Y represents the metallic element intensity of the fatty acid metal salt after the toner has been passed through a sieve having a mesh size of 25 μm (635 mesh) three times.

The extent to which the fatty acid metal salt is liberated in actual image formation can be estimated by determining the ease of the liberation of the fatty acid metal salt by the method. The toner is passed through the mesh, so that the fatty acid metal salt which adheres to the toner so as to be easily liberated comes to be in a cloud-like state or adheres to the mesh at the time of passing through the mesh. As a result, the amount of the fatty acid metal salt in the toner decreases, and the liberation ratio determined by the above measurement increases. The smaller the liberation ratio, the smaller the difference between the amount of the fatty acid metal salt before passing through the mesh and the amount of the fatty acid metal salt after passing through the mesh: the liberation of the fatty acid metal salt is suppressed even when printing is performed on a large number of sheets. Accordingly, when the liberation ratio is 20.0% or less, the effect as a lubricant is sufficiently exerted, and hence the suppression of the filming as the effect of the present invention can be achieved.

A fatty acid metal salt has such a property that it is liberated more readily than other additives. The fatty acid metal salt in the present invention can be somewhat easily adhered to toner particles because the particles of the fatty acid metal salt have a smaller particle diameter than the particles of conventional fatty acid metal salts. The design of the toner particles and conditions for the step of mixing the toner particles (such as temperature and rotation time) must be optimized in order that the liberation ratio can fall within the range of the present invention. The fatty acid metal salt preferably has a span value B of 1.75 or less defined by the following equation (1):

$$\text{Span value } B=(D95s-D5s)/D50s \quad (1)$$

D5s: the 5% accumulated diameter on a volume basis of the fatty acid metal salt

D50s: the 50% accumulated diameter on a volume basis of the fatty acid metal salt D95s: the 95% accumulated diameter on a volume basis of the fatty acid metal salt.

The span value B is an indicator showing the grain size distribution of the fatty acid metal salt. When the span value B is 1.75 or less, a variation in the particle diameter of the particles of the fatty acid metal salt present in the toner becomes small, so additionally high charging stability can be obtained. When the span value B exceeds 1.75, the amount of toner charged to reverse polarity tends to increase, so fogging is liable to occur. The span value B is more preferably 1.50 or less because an additionally stable image can be obtained when the span value is 1.50 or less. The span value is still more preferably 1.35 or less.

A fatty acid metal salt to be suitably used is preferably a salt of a metal selected from zinc, calcium, magnesium, aluminum, and lithium. In addition, a fatty acid zinc salt or a fatty acid calcium salt is particularly preferable because the effect of the present invention becomes additionally significant when such salts are used.

In addition, the fatty acid of the fatty acid metal salt is preferably a higher fatty acid having 12 or more and 22 or less carbon atoms. The use of a fatty acid having 12 or more carbon atoms can easily suppress the generation of a free fatty acid. The amount of the free fatty acid is preferably 0.20 mass % or less. When the fatty acid has 22 or less carbon atoms, the melting point of the fatty acid metal salt does not become excessively high, so good fixability can be easily obtained. The fatty acid is particularly preferably stearic acid.

Examples of the fatty acid metal salt include zinc stearate, calcium stearate, magnesium stearate, aluminum stearate, lithium stearate, and zinc laurate.

The fatty acid metal salt is added in an amount of preferably 0.02 part by mass or more and 0.50 part by mass or less, or more preferably 0.05 part by mass or more and 0.30 part by mass or less, with respect to 100 parts by mass of the toner particles. When the addition amount is 0.02 part by mass or more, the effect of adding the fatty acid metal salt is sufficiently obtained. In addition, when the amount is 0.50 part by mass or less, the stability of an image density increases significantly.

From the viewpoints of high developability and high image quality, the toner of the present invention preferably has a ratio (A/B) of 0.25 or more and 0.75 or less of a span value A found from the following equation (2) by using data on the number-based grain size distribution of the toner to the span value B:

$$\text{Span value } A=(D95t-D5t)/D50t \quad (2)$$

D5t: the 5% accumulated diameter on a number basis of the toner

D50t: the 50% accumulated diameter on a number basis of the toner

D95t: the 95% accumulated diameter on a number basis of the toner.

When the ratio between the span values falls within such a range, a balance is established between the grain size distribution of the toner and the grain size distribution of the fatty acid metal salt, so a variation in the presence state of the fatty acid metal salt between the toner particles is suppressed. As a result, the toner achieves a good balance between fogging and image density, and provides a high-quality image. When the ratio between the span values is less than 0.25, the grain size distribution of the fatty acid metal salt is broad as compared with the grain size distribution of the toner, so the toner is insufficiently charged, and fogging is apt to occur. In contrast, when the ratio exceeds 0.75, the grain size distribution of the fatty acid metal salt is excessively sharp as compared with the grain size distribution of the toner. In this case, a certain suppressing effect on fogging can be obtained, but density stability cannot be obtained, though the reason for this is unclear. As a result, a reduction in density is liable to occur. The ratio (A/B) between the span values is more preferably 0.30 or more and 0.70 or less in consideration of a balance between fogging and density stability.

The toner of the present invention preferably has a number average particle diameter (D1) of 3.0 to 8.0 μm in order that minuter latent image dots can be faithfully developed for obtaining an image having higher quality. When the number average particle diameter falls within the above range, high transfer efficiency can be obtained, and the scattering of the toner can be suppressed, so particularly good image formation can be performed. In addition, the abrasion of a photosensitive member and the melt adhesion of the toner can be inhibited from occurring. In addition, the toner can obtain additionally good chargeability because the toner becomes excellent in flowability and a stirring property.

In addition, the toner of the present invention preferably satisfies the following conditions in a microcompression test: a maximum displacement ratio $R_{100}$ of a particle of the toner when a load of $9.8\times10^{-4}$ N is applied to the particle at a loading rate of $9.8\times10^{-5}$ N/sec preferably satisfies the relationship of $0.20\leqq R_{100}\leqq0.90$, and a displacement ratio $R_{20}$ of the particle at a load of $2.0\times10^{-4}$ N preferably satisfies the relationship of $0.010\leqq R_{20}\leqq0.080$. The above characteristics are physical properties greatly involved in the nature of the toner particles, and when setting the characteristics within the above ranges, the deterioration of the toner can be suppressed and the liberation ratio of the fatty acid metal salt can be suitably controlled. In addition, the deformation of the toner having the above characteristics at a relatively small load is kept at a moderate level, so the deterioration of the toner due to, for example, a stress received from a developing member is suppressed, and the effect of suppressing filming at the time of adding the fatty acid metal salt is maintained over a long time period. Meanwhile, the ratio at which the toner deforms at a large load applied in fixing is high, so high gloss is easily obtained. In addition, the contact area between the toner and a fixing portion increases, so heat transferability is improved, and high fixability is obtained.

When $R_{100}$ falls within the above range, the displacement of the particles of the toner in a fixing step is moderate, a high-gloss image is obtained, and good low-temperature fixability can be achieved. In addition, the generation of deformed particles can be suppressed even when printing is performed on a large number of sheets.

When $R_{20}$ falls within the above range, the deformation of the particles of the toner due to a stress received from a developing member can be suitably suppressed, and the effect of suppressing filming can be obtained over a long time period. In addition, the loss of the toner particles or the exudation of a wax component can be suppressed, and the occurrence of fogging or a development stripe can be favorably suppressed. $R_{100}$ more preferably satisfies the relationship of $0.40\leqq R_{100}\leqq0.80$, and $R_{20}$ more preferably satisfies the relationship of $0.020\leqq R_{20}\leqq0.060$.

Further, the toner preferably has a viscosity at 100° C. of 8,000 Pa·s or more and 65,000 Pa·s or less. The above characteristic is also a physical property greatly involved in the nature of the toner particles, and serves as one approach to controlling the liberation ratio. In addition, the toner in which the above characteristic falls within a preferable range is excellent in low-temperature fixability and durability, and can favorably provide a high-gloss image.

In addition, the toner preferably has an average circularity measured with a flow-type particle image analyzer of 0.940 or more and 0.990 or less. When the average circularity falls within the above range, the maldistribution of the fatty acid metal salt can be suppressed, so a charge distribution in toner becomes sharp, and the occurrence of fogging can be favorably suppressed. In addition, the contact area between each toner particle and the fatty acid metal salt becomes suitable, so excessive liberation of the fatty acid metal salt from the toner can be suppressed, and the effect of suppressing filming on a toner bearing member becomes additionally significant. The average circularity is more preferably 0.950 or more and 0.985 or less, or still more preferably 0.960 or more and 0.980 or less because the stability of image quality is achieved at a higher level.

Next, a method of producing the toner will be described.

The toner particles used in the present invention, which may be produced by employing any method, are preferably obtained by a production method involving granulation in an aqueous medium such as a suspension polymerization method, an emulsion polymerization method, or a suspension granulation method.

Hereinafter, the method of producing the toner will be described by taking as an example the suspension polymerization method most suitable in obtaining the toner particles used in the present invention.

The binder resin, the colorant, and, as required, other additives such as a wax component are uniformly dissolved or dispersed with a dispersing machine such as a homogenizer, a ball mill, a colloid mill, or an ultrasonic dispersing machine, and a polymerization initiator is dissolved in the resultant so that a polymerizable monomer composition may be prepared. Next, polymerization is performed by suspending the polymerizable monomer composition in an aqueous medium containing a dispersion stabilizer, whereby the toner particles are produced.

The above polymerization initiator may be added to a polymerizable monomer simultaneously with the addition of other additives, or may be mixed immediately before a polymerizable monomer is suspended in the aqueous medium. Alternatively, the polymerization initiator dissolved in the polymerizable monomer or a solvent can be added immediately after granulation and before the initiation of the polymerization reaction.

The binder resin of the toner is, for example, a styrene-acrylic copolymer, a styrene-methacrylic copolymer, an epoxy resin, or a styrene-butadiene copolymer; each of them is generally used. A vinyl-based polymerizable monomer capable of radical polymerization can be used as the polymerizable monomer. A monofunctional polymerizable monomer or a polyfunctional polymerizable monomer can be used as the vinyl-based polymerizable monomer.

Examples of the polymerizable monomer for forming the binder resin include the following: a styrene-based monomers such as styrene, o-(m-, p-)methylstyrene, and m-(p-) ethylstyrene; acrylate-based monomers or methacrylate-based monomers such as methyl acrylate, methyl methacrylate, ethyl acrylate, ethyl methacrylate, propyl acrylate, propyl methacrylate, butyl acrylate, butyl methacrylate, octyl acrylate, octyl methacrylate, dodecyl acrylate, dodecyl methacrylate, stearyl acrylate, stearyl methacrylate, behenyl acrylate, behenyl methacrylate, 2-ethylhexyl acrylate, 2-ethylhexyl methacrylate, dimethyl aminoethyl acrylate, dimethyl aminoethyl methacrylate, diethyl aminoethyl acrylate, and diethylaminoethyl methacrylate; and ene-based monomers such as butadiene, isoprene, cyclohexene, acrylonitrile, methacrylonitrile, acrylamide, and methacrylamide.

Each of those polymerizable monomers is used alone, or, in general, two or more of them are appropriately mixed before use so that the mixture may show a theoretical glass transition temperature (Tg) described in a publication "Polymer Handbook", second edition, III-p 139 to 192 (published by John Wiley & Sons) of 40 to 75° C. When the theoretical glass transition temperature is lower than 40° C., problems in terms of the storage stability and durability of the toner are apt to arise. On the other hand, when the theoretical glass transition temperature exceeds 75° C., the fixability of the toner is lowered.

In addition, when the toner particles are produced, for example, a low-molecular-weight polymer is preferably added so that the THF soluble matter of the toner may show a preferable molecular weight distribution. When the toner particles are produced by the suspension polymerization method, the low-molecular-weight polymer can be added to the polymerizable monomer composition. The low-molecular-weight polymer is preferably as follows in terms of fixability and developability: the polymer has a weight average molecular weight (Mw) measured by gel permeation chromatography (GPC) in the range of 2,000 to 5,000, and has a ratio Mw/Mn of less than 4.5, or more preferably less than 3.0.

Examples of the low-molecular-weight polymer include a low-molecular-weight polystyrene, a low-molecular-weight styrene-acrylate copolymer, and a low-molecular-weight styrene-acrylic copolymer.

A polar resin having a carboxyl group such as a polyester resin or a polycarbonate resin is preferably used in combination with the above-mentioned binder resin.

When the toner particles are directly produced by the suspension polymerization method, the polar resin is preferably incorporated into the monomer composition before use. With such a procedure, the added polar resin forms a thin layer on the surface of each toner particle in accordance with a balance between the polarity of the polymerizable monomer composition to be made into the toner particles and the polarity of an aqueous dispersion medium. Alternatively, the polar resin is present with a concentration gradient from the surface of each toner particle to the center of the particle. That is, the addition of the polar resin can reinforce the shell portion of a core-shell structure, so the microcompression hardness of the toner can be easily optimized, and compatibility between the developability and the fixability can be favorably attained with ease.

The above polar resin is added in an amount of preferably 1 to 25 parts by mass, or more preferably 2 to 15 parts by mass, with respect to 100 parts by mass of the binder resin. The addition amount of less than 1 part by mass is not preferable because the presence state of the polar resin in each toner particle is apt to be nonuniform. The addition amount in excess of 25 parts by mass is not preferable because the layer of the polar resin formed on the surface of each toner particle becomes thick.

Examples of the polar resin include a polyester resin, an epoxy resin, a styrene-acrylic acid copolymer, a styrene-methacrylic acid copolymer, and a styrene-maleic acid copolymer. Of those, the polyester resin is particularly preferable, and the polar resin preferably has an acid value in the range of 4 to 20 mgKOH/g. When the acid value falls within the above range, a good shell structure can be formed, the toner is excellent in charge rising performance and environmental stability of charge, and the occurrence of a reduction in image density or fogging can be favorably suppressed. In addition, the polar resin preferably has a main peak molecular weight of 3,000 to 30,000 because the polar resin can improve the flowability and negative triboelectric charging characteristic of each toner particle.

A crosslinking agent may be used at the time of the synthesis of the binder resin for controlling the molecular weight of the THF soluble component of the toner while improving the mechanical strength of each toner particle.

Examples of a bifunctonal crosslinking agent include divinylbenzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of polyethylene glycol #200, #400, and #600, dipropylene glycol diacrylate, polypropylene glycol diacrylate, polyester-type diacrylates (MANDA, Nippon Kayaku Co., Ltd.), and those obtained by changing the above-mentioned diacylates to dimethacrylates.

Examples of a polyfunctional crosslinking agent include pentaerythritol triacrylate, trimethylolethane triacrylate, trimethylolpropane triacrylate, tetramethylolmethane tetraacrylate, oligoester acrylate and methacrylate thereof, 2,2-bis(4-mathacryloxypolyethoxyphenyl)propane, diacrylphthalate, triallylcyanurate, triallylisocyanurate, and triallyltrimelitate. The amount of those crosslinking agents to be added is preferably 0.05 to 10 parts by mass or more preferably 0.1 to 5 parts by mass, with respect to 100 parts by mass of the polymerizable monomer.

Examples of the polymerization initiator include: azo-based or diazo-based polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile; and peroxide-based polymerization initiators such as benzoyl peroxide, methyl ethyl ketone peroxide, diisopropyl oxycarbonate, cumene hydroperoxide, 2,4-dichlorobenzoyl peroxide, lauroyl peroxide, and tert-butyl-peroxypivalate.

Such polymerization initiators are used generally in an amount of 3 to 20 parts by mass with respect to 100 parts by mass of the polymerizable vinyl-based monomer, though depending on a target degree of polymerization. The kinds of polymerization initiators somewhat vary depending on polymerization methods, where the polymerization initiators are used each singly, or two or more kinds of them are used as a mixture with reference to 10-hour half-life temperature.

The toner of the present invention contains the colorant as an essential ingredient in order that coloring power may be imparted to the toner. A colorant that can be preferably used is, for example, any one of the following organic pigments, organic dyes, and inorganic pigments.

Examples of the organic pigments or organic dyes as a cyan colorant include: a copper phthalocyanine compound or derivatives thereof; an anthraquinone compound; and a basic dye lake compound. Specifically, the following are exemplified: C.I. Pigment Blue 1, C.I. Pigment Blue 7, C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 60, C.I. Pigment Blue 62, and C.I. Pigment Blue 66.

Examples of the organic pigments or organic dyes as a magenta colorant include: a condensed azo compound; a diketopyrrolopyrrol compound; anthraquinone; a quinacridone compound; a base dyed lake compound; a naphtol compound; a benzimidazolon compound; a thioindigo compound; and a perylene compound. Specifically, the following are exemplified: C.I. Pigment Red 2, C.I. Pigment Red 3, C.I. Pigment Red 5, C.I. Pigment Red 6, C.I. Pigment Red 7, C. I.

Pigment Violet 19, C.I. Pigment Red 23, C.I. Pigment Red 48:2, C.I. Pigment Red 48:3, C.I. Pigment Red 48:4, C.I. Pigment Red 57:1, C.I. Pigment Red 81:1, C.I. Pigment Red 122, C.I. Pigment Red 144, C.I. Pigment Red 146, C.I. Pigment Red 150, C.I. Pigment Red 166, C.I. Pigment Red 169, C.I. Pigment Red 177, C.I. Pigment Red 184, C.I. Pigment Red 185, C.I. Pigment Red 202, C.I. Pigment Red 206, C.I. Pigment Red 220, C.I. Pigment Red 221, and C.I. Pigment Red 254.

Examples of the organic pigments or organic dyes as a yellow colorant include: a condensed azo compound; an isoindoline compound; an anthraquinone compound; an azo metal complex; a methine compound; and an allyl amide compound. Specifically, the following are exemplified: C.I. Pigment Yellow 12, C.I. Pigment Yellow 13, C.I. Pigment Yellow 14, C.I. Pigment Yellow 15, C.I. Pigment Yellow 17, C.I. Pigment Yellow 62, C.I. Pigment Yellow 74, C.I. Pigment Yellow 83, C.I. Pigment Yellow 93, C.I. Pigment Yellow 94, C.I. Pigment Yellow 95, C.I. Pigment Yellow 97, C.I. Pigment Yellow 109, C.I. Pigment Yellow 110, C.I. Pigment Yellow 111, C.I. Pigment Yellow 120, C.I. Pigment Yellow 127, C.I. Pigment Yellow 128, C.I. Pigment Yellow 129, C.I. Pigment Yellow 147, C.I. Pigment Yellow 151, C.I. Pigment Yellow 154, C.I. Pigment Yellow 155, C.I. Pigment Yellow 168, C.I. Pigment Yellow 174, C.I. Pigment Yellow 175, C.I. Pigment Yellow 176, C.I. Pigment Yellow 180, C.I. Pigment Yellow 181, C.I. Pigment Yellow 191, and C.I. Pigment Yellow 194.

Examples of a black colorant include carbon black and one toned to black by using the above yellow colorant/magenta colorant/cyan colorant.

The colorants may be used each singly or as a mixture. Further, the colorants may be used in a solid solution state. The colorants used in the toner of the present invention are selected from hue angle, chroma saturation, brightness, weatherability, OHP transparency, and dispersibility in toner.

The addition amount of the colorants is preferably 1 to 20 parts by mass with respect to 100 parts by mass of the polymerizable monomer or the binder resin.

When the toner particles are obtained by employing a polymerization method, attention must be paid to the polymerization-inhibiting property and aqueous phase-migrating property of the colorant. The colorant is preferably subjected to a hydrophobic treatment with a substance that does not inhibit polymerization. Particular attention must be paid upon use of any one of the dye-based colorants and carbon black because many of them have a polymerization-inhibiting property. As a preferable method of treating a dye-based colorant, for example, a method may be cited involving polymerizing the polymerizable monomer in the presence of the colorant in advance, where the resultant colored polymer is added to the polymerizable monomer composition.

In addition, carbon black may be treated with a substance that reacts with a surface functional group of carbon black (such as polyorganosiloxane) as well as the same treatment as in the above dyes.

Any one of the known inorganic and organic dispersion stabilizers can be used as the dispersion stabilizer to be used at the time of the preparation of the aqueous medium.

Specifically, examples of the inorganic dispersion stabilizer include tricalcium phosphate, magnesium phosphate, aluminum phosphate, zinc phosphate, magnesium carbonate, calcium carbonate, calcium hydroxide, magnesium hydroxide, aluminum hydroxide, calcium metasilicate, calcium sulfate, barium sulfate, bentonite, silica, and alumina. In addition, as the organic dispersant, the following are exemplified: polyvinyl alcohol, gelatin, methyl cellulose, methyl hydroxypropyl cellulose, ethyl cellulose, sodium salt of carboxymethyl cellulose, and starch.

In addition, commercially available nonione-, anion-, and cation-type surfactants can be used. Examples of the surfactant include the following: sodium dodecyl sulfate, sodium tetradecyl sulfate, sodium pentadecyl sulfate, sodium octyl sulfate, sodium oleate, sodium laurate, potassium stearate, and calcium oleate.

The dispersion stabilizer to be used at the time of the preparation of the aqueous medium is preferably an inorganic, hardly-water-soluble dispersion stabilizer, or more preferably an acid-soluble, hardly-water-soluble, inorganic dispersion stabilizer.

In addition, when the aqueous medium is prepared by using a hardly-water-soluble, inorganic dispersion stabilizer, the dispersion stabilizer is preferably used in an amount of 0.2 to 2.0 parts by mass with respect to 100 parts by mass of the polymerizable monomer. In addition, in the present invention, the aqueous medium is preferably prepared by using 300 to 3,000 parts by mass of water with respect to 100 parts by mass of the polymerizable monomer composition.

When an aqueous medium in which such a hardly-water-soluble, inorganic dispersion stabilizer as described above is dispersed is prepared, a commercially available dispersion stabilizer may be dispersed as it is. Alternatively, the aqueous medium may be prepared by producing a hardly-water-soluble, inorganic dispersion stabilizer in a liquid medium such as water under high-speed stirring in order that dispersion stabilizer particles having a fine, uniform grain size may be obtained. For example, when tricalcium phosphate is used as a dispersion stabilizer, a preferable dispersion stabilizer can be obtained by forming the fine particles of tricalcium phosphate by mixing an aqueous solution of sodium phosphate and an aqueous solution of calcium chloride under high-speed stirring.

As the wax component, known one can be used in the present invention and specific examples include the following:

petroleum-based waxes and derivatives thereof such as paraffin wax, microcrystalline wax, and petrolatum; montan wax and derivatives thereof; hydrogen carbonate wax and derivative thereof by a Fischer-Tropsch method; polyolefin wax and derivatives thereof such as polyethylene wax and polypropylene wax; natural wax and derivatives thereof such as carnauba wax and candelilla wax; higher aliphatic alcohols; fatty acids such as stearic acid and palmitic acid; acid amide wax; ester wax; hardened castor oil and derivatives thereof; plant-based wax; and animal wax.

As the derivatives, oxidants, a block copolymer with a vinyl-based monomer, and graft modified products are exemplified.

In the toner, a charge control agent can be blended with the toner particles before use as required. Blending the charge control agent can stabilize the charge characteristic and optimize the triboelectric charge quantity in accordance with a developing system.

A known agent can be utilized as the charge control agent, and a charge control agent having the following characteristics is particularly preferable: the agent can be charged at a high speed, and can stably maintain a certain charge quantity. Further, when the toner particles are directly produced by a polymerization method, a charge control agent having the following characteristics is particularly preferable: the agent has a low polymerization-inhibiting property, and is substantially free of any soluble matter in the aqueous medium.

Examples of the charge control agent that can control the toner so as to have a negative charge include the following. For example, organic metal compounds and chelate compounds are effective, including monoazometal compounds, acetylacetone metal compounds, aromatic oxycarboxylic acids, aromatic dicarboxylic acids, and metal compounds of oxycarboxylic acids and dicarboxylic acids. Other examples include aromatic oxycarboxylic acids, aromatic mono- and polycarboxylic acids and metal salts, anhydrides, and esters thereof as well as phenol derivatives such as bisphenols. Further examples include urea derivatives, metal-containing salicylic acid-based compounds, metal-containing naphthoic-based acid compounds, boron compounds, quaternary ammonium salts, calixarene, and resin-based charge control agents.

In addition, examples of the charge control agent that can control the toner so as to have a positive charge include the following: nigrosine-modified products with nigrosine and fatty acid metal salts; guanidine compounds; imidazole compounds; tributylbenzylammonium-1-hydroxy-4-naphthosulfonic acid salts, quaternary ammonium salts such as tetrabutylammonium tetrafluoroborate, and analogues thereof including onium salts such as phosphonium salts and lake pigments thereof; triphenylmethane dyes and lake pigments thereof (laking agents include phosphotungstic acid, phosphomolybdic acid, phosphotungstomolybdic acid, tannic acid, lauric acid, gallic acid, ferricyanide, and ferrocyanide); metal salts of higher fatty acids; and resin-based charge control agents.

Those charge control agents may be incorporated each singly, or two or more kinds of them may be incorporated in combination.

Of those charge control agents, in order that the effect of the present invention may be sufficiently exerted, a metal-containing salicylic acid-based compound is preferable, and the metal is particularly preferably aluminum or zirconium. An aluminum compound of 3,5-di-tert-butylsalicylic acid is the most preferable charge control agent.

The charge control agent is blended in an amount of preferably 0.01 to 20 parts by mass, or more preferably 0.5 to 10 parts by mass, with respect to 100 parts by mass of the polymerizable monomer or the binder resin. However, the addition of the charge control agent is not indispensable to the toner of the present invention, and the triboelectric charging due to the friction between the toner and a toner layer thickness-regulating member or a toner bearing member is actively utilized, thereby eliminating the need for the incorporation of the charge control agent into the toner.

An existing, high-speed stirring mixer such as a Henschel mixer or a Super mixer can be used as a mixer to be used in the step of mixing the additives.

The incorporation of particles of a fatty acid metal salt having a volume-based median diameter (D50s) of 0.15 μm or more and 0.65 μm or less is indispensable to the toner of the present invention; furthermore, any other additive may be added to the toner. Examples of the additive include fine powders such as a silica fine powder, a titanium oxide fine powder, and a double oxide fine powder of them. Of the inorganic fine powders, the silica fine powder and the titanium oxide fine powder are preferable.

Examples of the silica fine powder include dry silica or fumed silica produced through the vapor phase oxidation of a silicon halide and wet silica produced from water glass. The dry silica is preferable in which the amount of silanol groups present on its surface and inside the silica fine powder is small, and the amounts of $Na_2O$ and $SO_3^{2-}$ are small. In addition, the dry silica may be a composite fine powder of silica and any other metal oxide obtained by using a metal halide such as aluminum chloride or titanium chloride and a silicon halide in combination in the production step.

The inorganic fine powder is added to the toner particles for improving the flowability of the toner and uniformizing the charge of the toner. The inorganic fine powder is preferably subjected to a hydrophobic treatment before use because the adjustment of the charge quantity of the toner, an improvement in environmental stability of the toner, and an improvement in characteristics of the toner under a high-humidity environment can be achieved by subjecting the inorganic fine powder to hydrophobic treatment. When the inorganic fine powder added to the toner absorbs moisture, the charge quantity of the toner is reduced, and a reduction in developability or transferability is apt to occur.

Examples of a treatment agent for making the inorganic fine powder hydrophobic include unmodified silicone varnish, various kinds of modified silicone varnish, unmodified silicone oil, various kinds of modified silicone oil, a silane compound, a silane coupling agent, organic silicone compound, and an organic titanium compound. Those treatment agents may be used alone or in combination.

Of those, an inorganic fine powder treated with silicone oil is preferable; a hydrophobic treatment inorganic fine powder obtained by treating an inorganic fine powder with silicone oil simultaneously with hydrophobic treatment with a coupling agent, or a hydrophobic treatment inorganic fine powder obtained by treating an inorganic fine powder with silicone oil after treatment with a coupling agent is more preferable. The use of any such hydrophobic treatment inorganic fine powder can maintain the charge quantity of the toner at a high level even under a high-humidity environment, and can reduce selective developability.

The total amount of the inorganic fine powder is preferably 1.5 to 5.0 parts by mass with respect to 100 parts by mass of the toner particles.

In addition, the toner particles and the fatty acid metal salt may be mixed under, for example, the following conditions in order that the liberation ratio of the fatty acid metal salt can fall within the range specified in the present invention.

In the step of mixing the toner particles and an additive, a stirring blade installed in a mixing unit moves, and the toner particles and the external additive receive energy from the stirring blade and then move to collide with each other, whereby the additive adheres to each toner particle.

At the time of initiating the mixing of the toner particles and the additive, a difference in moving speed arises between each toner particle and the additive by virtue of the difference in particle diameter or specific gravity between them, and the frequency at which each toner particle and the additive collide with each other increases. As a result, the uniformization of the additive in the toner primarily progresses. When the mixing is further continued so that the motion of each of the toner particles and the additive may be brought into a steady state, the relative moving speed difference between the respective particles becomes small. As a result, the frequency at which each toner particle and the additive collide with each other is reduced, and the adhesion of the additive to each toner particle mainly progresses by virtue of contact with, for example, the wall or the stirring blade.

In the present invention, the liberation ratio of the fatty acid metal salt must be controlled to fall within a certain range while the particle diameter of the particles of the fatty acid metal salt is maintained. The following procedure plays an important role in achieving this goal: the fatty acid metal salt is caused to exist on the surface of each toner particle in an additionally uniform fashion so as to be capable of adhering to each toner particle efficiently. Providing a pausing step in the mixing step has a certain effect when one wishes to cause the fatty acid metal salt to exist in the surface of each toner particle in an additionally uniform fashion. When the pausing step is provided so that the mixing step may be divided into several steps, the time period for which a difference in moving speed is arising between each toner particle and the fatty acid metal salt can be lengthened, and the extent to which the uniformization of the fatty acid metal salt on the surface of each toner particle progresses is enlarged as compared with those in the case where an ordinary mixing step is performed. Further, when the pausing step and the mixing step as described above is carried out repeatedly, the adhesion of the fatty acid metal salt to the surface of each toner particle can be effectively performed. As a result, the liberation ratio can be controlled to fall within a desired range while the loss of the fatty acid metal salt due to an excessive stress is suppressed. In addition, providing the pausing step can suppress a rise in temperature of each of the toner particles, an external additive, and the toner to be produced due to friction with, for example, the wall or the stirring blade. As a result, problems such as the exudation of wax from each toner particle or the cracking of each toner particle are inhibited from occurring, and high-quality images can be obtained.

The circumferential speed of the tip of the stirring blade in the mixing step preferably falls within the range of 32.0 m/sec or more to 78.0 m/sec or less. When the circumferential speed falls within such a range, the energy received from the stirring blade can be so controlled as not to involve abrupt heat generation. When the circumferential speed of the tip of the stirring blade falls within the above range, the liberation of the fatty acid metal salt can be suppressed without deterioration in the toner particles and the fatty acid metal salt.

In the pausing step, the following procedure is preferably adopted in order that a difference in moving speed can arise between each toner particle and the additive as described above: the circumferential speed of the stirring blade is reduced to 15.0 m/sec or less, and is kept in such a circumferential speed range for 10 seconds or more.

The temperature in the mixing unit as a tank during the mixing step is preferably set at a temperature of 42° C. or lower in order to inhibit the fatty acid metal salt, the toner particles and the toner as described above from deteriorating.

The physical properties of the fatty acid metal salt and the toner in the present invention were measured by employing the following methods.

<Measurement of Median Diameter and Span Value B of Fatty Acid Metal Salt>

The volume-based median diameter of the particles of the fatty acid metal salt used in the present invention is measured in conformance with JIS Z8825-1 (2001). A specific method for the measurement is as described below.

A laser diffraction/scattering grain size distribution measuring apparatus "LA-920" (manufactured by HORIBA, Ltd.) is used as a measuring apparatus. Dedicated software "HORIBA LA-920 for Windows (registered trademark) WET (LA-920) Ver. 2.02" attached to the LA-920 is used for setting measurement conditions and analyzing measurement data. In addition, ion-exchanged water from which impurity solid matters, etc. have been removed in advance is used as a measurement solvent.

A measurement procedure is as described below.

(1) A batch-type cell holder is attached to the LA-920.

(2) A predetermined amount of ion-exchanged water is charged into a batch-type cell, and the batch-type cell is set in the batch-type cell holder.

(3) The inside of the batch-type cell is stirred with a dedicated stirrer chip.

(4) A file "110A000I" (relative refractive index 1.10) is selected by pushing the "refractive index" button of a "display condition setting" screen.

(5) The basis on which a particle diameter is measured is set to a volume basis in the "display condition setting" screen.

(6) After warm-up is carried out for 1 hour or more, the adjustment of an optical axis, the fine adjustment of the optical axis and blank measurement are performed.

(7) About 60 ml of the ion-exchange water are charged into a 100-ml flat-bottom beaker made of glass. About 0.3 ml of a diluted solution prepared by diluting about three-mass-fold a "Contaminon N" (a 10-mass % aqueous solution of a neutral detergent for washing a precision measuring instrument, including a nonionic surfactant, an anionic surfactant and an organic builder and having a pH of 7, manufactured by Wako Pure Chemical Industries, Ltd.) with ion-exchange water, is added as a dispersant to ion-exchange water.

(8) An ultrasonic dispersing unit "Ultrasonic Dispersion System Tetra 150" (manufactured by Nikkaki Bios Co., Ltd.) is prepared which two oscillators having an oscillatory frequency of 50 kHz are built in so as to shift a phase by 180° and which has an electrical output of 120 W is prepared. About 3.31 l of ion-exchange water is charged into the water tank of the ultrasonic dispersing unit. About 2 ml of the Contaminon N are charged into the water tank.

(9) The beaker in the above (7) is set in the beaker fixing hole of the ultrasonic dispersing unit, and the ultrasonic dispersing unit is operated. Then, the height position of the beaker is adjusted in order that the resonance state of the liquid level of the aqueous solution in the beaker can become maximum.

(10) About 1 mg of the fatty acid metal salt is gradually added to and dispersed in the aqueous solution in the beaker in the above (9) in such a state that the aqueous solution in the beaker is irradiated with the ultrasonic wave. Then, the ultrasonic dispersion treatment is continued for additional 60 seconds. It should be noted that at this time point, the fatty acid metal salt may float in the form of blocks on the liquid level. In this case, the beaker is shaken for sinking the block in water before the ultrasonic dispersion is performed for 60 seconds. In addition, at the time of the ultrasonic dispersion, the temperature of water in the water bath is appropriately adjusted to be 10° C. or higher and 40° C. or lower.

(11) The aqueous solution prepared in the above (10) in which the fatty acid metal salt is dispersed is immediately added to the batch-type cell little by little so that transmittance for a tungsten lamp may be adjusted to 90% to 95% while attention is paid for preventing the aqueous solution from bearing air bubbles. Then, the measurement of the grain size distribution is made. The 5% accumulated diameter, 50% accumulated diameter, and 95% accumulated diameter are calculated on the basis of the resultant data on the grain size distribution on a volume basis. The resultant values are defined as D5s, D50s, and D95s, and the span value B is found from these values.

<Liberation Ratio of Fatty Acid Metal Salt>

The liberation ratio of the fatty acid metal salt in the toner in the present invention is determined with a Powder Tester (manufactured by Hosokawa Micron Corporation) having a digital vibration meter (DIGIVIBLO MODEL 1332), a fluorescent X-ray analyzer Axios (manufactured by PANalytical), and dedicated software "SuperQ ver. 4.0F" (manufactured by PANalytical) attached to the analyzer for setting measurement conditions and analyzing measurement data from the difference in intensity between fluorescent X-rays.

A specific measurement method is as described below.

(1) About 4 g of the toner are mounted on an aluminum ring having a diameter of 40 mm, and are compressed with a pressing machine at 150 kN so that a sample may be produced. The resultant sample is subjected to measurement with the fluorescent X-ray analyzer (Axios) so that the metallic element intensity of the fatty acid metal salt in the toner may be obtained.

(2) A sieve having a mesh size of 25 μm (635 mesh) is set on the vibrating table of the Powder Tester. 5 g of the toner is accurately weighed and mounted on the sieve, and is then vibrated for about 2 minutes while the amplitude of the digital vibration meter is adjusted to about 0.60 mm. The above operation is further repeated twice so that the toner may be passed through the 25 μm (635 mesh) sieve three times in total. Next, about 4 g of the resultant sample is mounted on an aluminum ring having a diameter of 40 mm, and is compressed with a pressing machine at 150 kN so that a sample may be produced. The resultant sample is subjected to measurement with the fluorescent X-ray analyzer (Axios) so that the metallic element intensity of the fatty acid metal salt which has been passed through the sieve three times may be obtained.

It should be noted that Rh is used as the anode of an X-ray tube, a measurement environment is a vacuum, a measurement diameter (collimator mask diameter) is 27 mm, and a measurement time is 10 seconds. In addition, a proportional counter (PC) is used for detecting a light element, and a scintillation counter (SC) is used for detecting a heavy element.

The liberation ratio of the fatty acid metal salt is found from the following equation by measuring the Kα-ray net intensities (KCPS) of the metallic element of the fatty acid metal salt before and after being sieved.

{(Kα-ray net intensity of metallic element of fatty acid metal salt in toner before being sieved)−(Kα-ray net intensity of metallic element of fatty acid metal salt in toner after being sieved)}/(Kα-ray net intensity of metallic element of fatty acid metal salt in toner before being sieved)

<Amount of Free Fatty Acid of Fatty Acid Metal Salt>

The amount of a free fatty acid of the fatty acid metal salt in the present invention is measured as described below. 1 g of a sample is precisely weighed, and is dissolved in a mixed solution of ethanol and ethyl ether at a ratio of 1:1. The solution is subjected to neutralization titration with an aqueous solution of potassium hydroxide by using phenolphthalein as an indicator so that the content of the free fatty acid can be determined.

<Measurement of Number Average Particle Diameter (D1) and Span Value A of Toner>

The number average particle diameter (D1) of toner is calculated as follows. The measuring apparatus used is a precision grain size distribution measuring apparatus based on a pore electrical resistance method provided with a 100 μm aperture tube "Coulter Counter Multisizer 3" (registered trademark, manufactured by Beckman Coulter, Inc). Dedicated software attached to the apparatus "Beckman Coulter Multisizer 3 Version 3.51" (manufactured by Beckman Coulter, Inc) is used for setting measurement conditions and analyzing measurement data. It should be noted that the number of effective measurement channels is set to be 25,000 to perform the measurement.

An electrolyte solution prepared by dissolving special grade sodium chloride in ion-exchange water to have a concentration of about 1 mass %, for example, an "ISOTON II" (manufactured by Beckman Coulter, Inc), can be used in the measurement.

It should be noted that the dedicated software was set as described below prior to the measurement and the analysis.

In the "change standard measurement method (SOM)" screen of the dedicated software, the total count number in a control mode is set to be 50,000 particles, the number of times of measurement is set to be 1, and a value obtained by using "standard particles having a particle diameter of 10.0 μm" (manufactured by Beckman Coulter, Inc) is set as a Kd value. A threshold and a noise level are automatically set by pressing a "threshold/noise level measurement button". In addition, a current is set to 1,600 μA, a gain is set to 2, and an electrolyte solution is set to be an ISOTON II, and a check mark is placed in a check box as to whether "the aperture tube is flushed after the measurement".

In the "setting for conversion from pulse to particle diameter" screen of the dedicated software, a bin interval is set to a logarithmic particle diameter, the number of particle diameter bins is set to 256, and a particle diameter range is set to the range of 2 μm to 60 μm.

A specific measurement method is as described below.

(1) About 200 ml of the electrolyte solution are charged into a 250 ml round-bottom beaker made of glass, dedicated for the Multisizer 3. The beaker is set in a sample stand, and the electrolyte solution in the beaker is stirred with a stirrer rod at 24 rotations/sec in a counterclockwise direction. Then, dirt and bubbles in the aperture tube are removed by the "aperture flush" function of the analysis software.

(2) About 30 ml of the electrolyte solution are charged into a 100 ml flat-bottom beaker made of glass. About 0.3 ml of a diluted solution prepared by diluting about three-mass-fold a "Contaminon N" (a 10 mass % aqueous solution of a neutral detergent for washing a precision measuring instrument, including a nonionic surfactant, an anionic surfactant and an organic builder and having pH of 7, manufactured by Wako Pure Chemical Industries, Ltd.) with ion-exchange water is added as a dispersant to the electrolyte solution.

(3) An ultrasonic dispersing unit "Ultrasonic Dispersion System Tetra 150" (manufactured by Nikkaki Bios Co., Ltd.) is prepared which two oscillators each having an oscillatory frequency of 50 kHz are built in so as to shift a phase by 180° and which has an electrical output of 120 W. A predetermined amount of ion-exchanged water is charged into the water tank of the ultrasonic dispersing unit. About 2 ml of the Contaminon N are charged into the water tank.

(4) The beaker described in the above (2) is set in the beaker fixing hole of the ultrasonic dispersing unit, and the ultrasonic dispersing unit is operated. Then, the height position of the beaker is adjusted in order that the resonance state of the liquid level of the electrolyte solution in the beaker can become maximum.

(5) About 10 mg of toner are gradually added to and dispersed in the electrolyte solution in the beaker described in the above (4) in such a state that the electrolyte solution is irradiated with the ultrasonic wave. Then, the ultrasonic dispersion treatment is continued for an additional 60 seconds. It should be noted that the temperature of water in the water bath is appropriately adjusted so as to be 10° C. or higher and 40° C. or lower at the time of ultrasonic dispersion.

(6) The electrolyte solution described in the above (5) in which the toner has been dispersed is dropwise added by means of a pipette to the round-bottom beaker described in the above (1), placed in the sample stand, and the measurement concentration is adjusted to about 5%. Then, measurement is performed until the particle diameters of 50,000 particles are measured.

(7) The measurement data is analyzed with the dedicated software attached to the apparatus, and the number average particle diameter (D1) and span value A are calculated. It should be noted that an "average diameter" on the "analysis/volume statistics (arithmetic average)" screen of the dedicated software when the dedicated software is set to show a graph/number % is the number average particle diameter (D1). Further, an "d10" on the "analysis/number statistics (arithmetic average)" screen of the dedicated software is the 10% accumulated diameter on a number basis. The "d 50" is the 50% accumulated diameter on a number basis, and the "d90" is the 90% accumulated diameter on a number basis. The resultant values are defined as D10t, D50t, and D90t, and the span value A is found from these values.

<Microcompression Test on Toner>

Microcompression measurement for the toner in the present invention was performed by using an ultramicro hardness meter ENT1100 (manufactured by ELIONIX CO., LTD). A specific measurement method is as described below. The toner was applied onto a ceramic cell, and fine air is blown so that the toner can be dispersed on the cell. The cell is set in the apparatus so as to be subjected to the measurement.

The particles of the toner which are not in an agglomerated state but are isolated from each other in a screen for measurement (horizontal width: 160 μm, vertical width: 120 μm) are selected with a microscope attached to the apparatus, and are employed as measurement objects. The particles each having a particle diameter in the range of the number average particle diameter (D1)±0.20 μm are selected for measurement so that a displacement amount error can be reduced as much as possible.

100 particles of the toner each satisfying the above condition were selected, and a maximum displacement amount $X_{100}$ (μm) of one particle at the time of applying a load of $9.8\times10^{-4}$ N to one particle of the toner at a loading rate of $9.8\times10^{-5}$ N/sec, a displacement amount $X_{20}$ (μm) of the particle at a load of $2.0\times10^{-4}$ N, and a particle diameter D of the particle to be measured are measured. Data processing was performed as described below. Data on particles providing the 1st to 10th largest values and the 1st to 10th smallest values are removed from the results of the measurement of the maximum displacement amount $X_{100}$ (μm), and data on the remaining 80 particles are used. Values for the ratios $X_{100}/D$ and $X_{20}/D$ of each of the 80 particles are calculated, and the arithmetic average of the calculated values for each of the ratios $X_{100}/D$ and $X_{20}/D$ is calculated. The averages are defined as the maximum displacement ratio $R_{100}$ and the displacement ratio $R_{20}$ in the present invention. It should be noted that a value for [(major axis+minor axis)/2] determined from the major axis and minor axis of each toner particle measured with software attached to the ultramicro hardness meter ENT1100 is used as the toner particle diameter D (μm).

<Method of Measuring Viscosity of Toner at 100° C.>

The viscosity of the toner at 100° C. is measured with a constant-load extruding capillary rheometer "flow characteristic evaluating apparatus Flow Tester CFT-500D" (manufactured by SHIMADZU CORPORATION) in accordance with the manual attached to the apparatus. It should be noted that in the apparatus, the following procedure is adopted. While a constant load is applied from above a measurement sample charged into a cylinder with a piston, the temperature of the measurement sample is increased so that the measurement sample can be melted. The molten measurement sample is extruded from a die at the bottom of the cylinder, and a relationship between the temperature of the measurement sample and the falling amount of the piston at this time point is measured.

In the present invention, the measurement is performed in the range of 50° C. to 200° C., and an apparent viscosity calculated at 100° C. is defined as the viscosity (Pa·s) of the toner at 100° C.

An apparent viscosity η (Pa·s) at 100° C. is calculated as described below. First, a flow rate Q ($cm^3/s$) is calculated from the following equation (3). In the equation, A represents the sectional area ($cm^2$) of the piston, and Δt represents a time period (seconds) required for the piston to fall in the vertical range of the position of the piston at 100° C.±0.10 mm (an interval of 0.20 mm).

$$Q=(0.20\times A)/(10\times\Delta t) \quad (3)$$

Then, the apparent viscosity η at 100° C. is calculated from the following equation (4) by using the resultant flow rate Q. In the equation, P represents a piston load (Pa), B represents the diameter (mm) of a die hole, and L represents the length (mm) of the die.

$$\eta=(n\times B^4\times P)/(128{,}000\times L\times Q) \quad (4)$$

A cylindrical product having a diameter of about 8 mm obtained by the following procedure is used as the measurement sample: about 1.0 g of the toner is subjected to compression molding under an environment having a temperature of 25° C. by means of a tablet molding compressor (such as an NT-100H manufactured by NPa SYSTEM CO., LTD.) at about 10 MPa for about 60 seconds. Measurement conditions for the CFT-500D are as described below.

| | |
|---|---|
| Test mode: | A temperature increase method |
| Starting temperature: | 50° C. |
| Ultimate temperature: | 200° C. |
| Measurement interval: | 1.0° C. |
| Rate of temperature increase: | 4.0° C./min |
| Sectional area of piston: | 1.000 $cm^2$ |
| Test load (piston load): | 10.0 kgf (0.9807 MPa) |
| Preheating time: | 300 seconds |
| Diameter of die hole: | 1.0 mm |
| Length of die: | 1.0 mm |

<Average Circularity of Toner>

Measurement is performed using a flow-type particle image measuring apparatus "FPIA-2100" (manufactured by SYSMEX CORPORATION), and the average circularity of toner is calculated using the following equations.

$$\text{Circle-equivalent diameter}=(\text{particle projected area}/\pi)^{1/2}\times2$$

Circularity=(circumferential length of a circle having the same area as particle projected area)/(circumferential length of a particle projected image)

The term "particle projected area" refers to the area of a binarized particle image, and the term "circumferential length of a particle projected image" is defined as the length of a border line obtained by connecting the edge points of the particle image. The circularity is an indicator for the degree of surface unevenness of a particle. The circularity is 1.000 when the particle is in a completely spherical shape. The more complicated the surface shape of the particle, the lower the circularity.

A specific measurement method is as described below. First, 10 ml of ion-exchange water which impurity matters, etc. have been removed from in advance are prepared in a container. A surfactant (alkyl benzene sulfonate) is added as a dispersant to the ion-exchange water, and then 0.02 g of a measurement sample is added to and uniformly dispersed in the mixture. The dispersion treatment is performed for 2 minutes by means of an ultrasonic dispersing unit "Tetra 150" (manufactured by Nikkaki Bios Co., Ltd.), whereby a dispersion liquid for measurement is obtained. At that time, the dispersion liquid is appropriately cooled so as not to have a temperature of 40° C. or higher. In addition, in order that a variation in circularity can be suppressed, the temperature of an environment in which the flow-type particle image analyzer FPIA-2100 is placed is controlled at 23° C.±0.5° C. so that the temperature in the analyzer is in the range of 26 to 27° C. Then, automatic focusing is performed by using a 2 μm latex particle at a predetermined time interval, or preferably at an interval of 2 hours.

The circularities of the toner particles are measured with the flow-type particle image measuring apparatus while the concentration of the dispersion liquid is readjusted so that a toner concentration at the time of the measurement becomes about 3,000 to 10,000 particles/μl. Then, 1,000 or more toners are measured. After the measurement, the average circularity of the toner is determined by using the data while data on particles each having a circle-equivalent diameter of less than 2 μm is discarded.

EXAMPLES

Hereinafter, the present invention will be described more specifically by way of examples. However, the present invention is not limited to the following examples. The terms "part(s)" and "%" in examples and comparative examples refer to "part(s) by mass" and "mass %", respectively unless otherwise stated.

First, toner production examples will be described.

<Production of Toner Particles 1>

Toner by Suspension Polymerization Method 16.5 parts by mass of a C.I. Pigment Blue 15:3 and 2.0 parts by mass of an aluminum compound of 3,5-di-tert-butylsalicylic acid [BONTRON E88 (manufactured by Orient Chemical Industries, Ltd.)] were prepared with respect to 100 parts by mass of a styrene monomer. Those components were introduced into an Attritor (manufactured by MITSUI MINING. CO., LTD.), and the mixture was stirred with zirconia beads each having a radius of 1.25 mm (140 parts by mass) at 200 rpm and 25° C. for 180 minutes, whereby master batch dispersion liquid 1 was prepared.

450 parts by mass of a 0.1-mol/l aqueous solution of $Na_3PO_4$ were charged into 710 parts by mass of ion-exchange water, and the mixture was heated to 60° C. After that, 68 parts by mass of a 1.0-mol/l aqueous solution of $CaCl_2$ was gradually added to the mixture, whereby an aqueous medium containing a calcium phosphate compound was obtained.

| | |
|---|---|
| Master batch dispersion liquid 1 | 40 parts by mass |
| Styrene monomer | 30 parts by mass |
| n-butyl acrylate monomer | 18 parts by mass |
| Low-molecular-weight polystyrene (Mw = 3,000, Mn = 1,050, Tg = 55° C.) | 20 parts by mass |
| Hydrocarbon wax (Fischer-Tropsch wax, the peak temperature of highest endothermic peak = 78° C., Mw = 750) | 9 parts by mass |
| Polyester resin (polycondensate having a ratio of terephthalic acid: isophthalic acid:propylene oxide-modified bisphenol A (2-mol adduct):ethylene oxide-modified bisphenol A (2-mol adduct) = 30:30:30:10, acid value = 11 mgKOH/g, Tg = 74° C., Mw = 11,000, Mn = 4,000) | 5 parts by mass |

The above materials were heated to 65° C., and were then uniformly dissolved and dispersed with a TK-homomixer (manufactured by Tokushu Kika Kogyo) at 5,000 rpm. 7.0 parts by mass of a 70% solution of a polymerization initiator 1,1,3,3-tetramethylbutylperoxy-2-ethyl hexanoate in toluene was dissolved in the resultant, whereby a polymerizable monomer composition was prepared.

The above polymerizable monomer composition was added to the aqueous medium, and the mixture was stirred under an $N_2$ atmosphere by means of the TK-homomixer at a temperature of 65° C. and 10,000 rpm for 10 minutes, whereby the polymerizable monomer composition was granulated. After that, the temperature of the mixture was raised to 67° C. while the mixture was stirred with a paddle stirring blade. When the polymerization conversion of the polymerizable vinyl-based monomers reached 90%, a 0.1-mol/l aqueous solution of sodium hydroxide was added to the mixture to adjust the pH of the aqueous dispersion medium to 9. Further, the temperature of the mixture was increased to 80° C. at a temperature rise rate of 40° C./h, and then the mixture was subjected to reaction for 4 hours. After the completion of the polymerization reaction, the remaining monomers in toner particles were removed by distillation under reduced pressure. After the aqueous medium had been cooled, hydrochloric acid was added to the aqueous medium to adjust the pH to 1.4, and then the mixture was stirred for 6 hours, whereby the calcium phosphate salt was dissolved. The toner particles were separated by filtration and washed with water, and were then dried at a temperature of 40° C. for 48 hours, whereby cyan-colored toner particles (1) were obtained. Table 1 shows the formulation of the toner particles.

<Production of Toner Particles 2>

Toner particles 2 were obtained in the same manner as in the toner particles 1 except that: the addition amount of the low-molecular-weight polystyrene was changed to 10 parts by mass; the addition amount of the styrene monomer was changed to 38 parts by mass; the amount of the n-butyl acrylate monomer was changed to 20 parts by mass. Table 1 shows the formulation of the toner particles 2.

<Production of Toner Particles 3>

Toner particles 3 were obtained in the same manner as in the toner particles 1 except that: the addition amount of the low-molecular-weight polystyrene was changed to 40 parts by mass; the addition amount of the styrene monomer was changed to 14 parts by mass; the amount of the n-butyl acrylate monomer was changed to 13 parts by mass; and the amount of the 70% solution of the polymerization initiator 1,1,3,3-tetramethylbutylperoxy-2-ethyl hexanoate in toluene was changed to 7.5 parts by mass. Table 1 shows the formulation of the toner particles 3.

<Production of Toner Particles 4>

Toner particles 4 were obtained in the same manner as in the toner particles 1 except that: the low-molecular-weight polystyrene was not added; the addition amount of the styrene monomer was changed to 47 parts by mass; the amount of the n-butyl acrylate monomer was changed to 23 parts by mass; and the amount of the 70% solution of the polymerization initiator 1,1,3,3-tetramethylbutylperoxy-2-ethyl hexanoate in toluene was changed to 5.0 parts by mass. Table 1 shows the formulation of the toner particles 4.

<Production of Toner Particles 5>

Toner particles 5 were obtained in the same manner as in the toner particles 1 except that: the addition amount of the low-molecular-weight polystyrene was changed to 40 parts by mass; the addition amount of the styrene monomer was changed to 14 parts by mass; the amount of the n-butyl acrylate monomer was changed to 13 parts by mass; and the amount of the 70% solution of the polymerization initiator 1,1,3,3-tetramethylbutylperoxy-2-ethyl hexanoate in toluene was changed to 8.5 parts by mass. Table 1 shows the formulation of the toner particles 5.

TABLE 1

| | | | Toner particle production example No. | | | | |
|---|---|---|---|---|---|---|---|
| | | | Toner particle production example 1 | Toner particle production example 2 | Toner particle production example 3 | Toner particle production example 4 | Toner particle production example 5 |
| | | | Toner particles No. | | | | |
| | | | Toner particle 1 | Toner particle 2 | Toner particle 3 | Toner particle 4 | Toner particle 5 |
| | | | Toner production method | | | | |
| | | | Suspension polymerization method | Suspension polymerization method | Suspension polymerization method | Suspension polymerization method | Suspension polymerization method |
| Master batch dispersion liquid | | Addition amount (parts) | 40 | 40 | 40 | 40 | 40 |
| Monomer | Styrene monomer | Addition amount (parts) | 30 | 38 | 14 | 47 | 14 |
| | n-butyl acrylate | Addition amount (parts) | 18 | 20 | 13 | 23 | 13 |
| Initiator | 1,1,3,3-tetramethyl-butylperoxy-2-ethyl hexanoate | Addition amount (parts) | 7.0 | 7.0 | 7.5 | 5.0 | 8.5 |
| Styrene-based resin | | Addition amount (parts) | 20 | 10 | 40 | — | 40 |
| | | Average molecular weight (Mw) | 3,000 | 3,000 | 3,000 | — | 3,000 |
| | | Glass transition point (° C.) | 55 | 55 | 55 | — | 55 |
| Polyester-based resin | | Addition amount (parts) | 5 | 5 | 5 | 5 | 5 |
| | | Average molecular weight (Mw) | 11,000 | 11,000 | 11,000 | 11,000 | 11,000 |
| | | Acid value | 11 | 11 | 11 | 11 | 11 |
| Wax | | Kind | Fischer-Tropsch | Fischer-Tropsch | Fischer-Tropsch | Fischer-Tropsch | Fischer-Tropsch |
| | | Addition amount (parts) | 9 | 9 | 9 | 9 | 9 |
| | | Melting point (° C.) | 78 | 78 | 78 | 78 | 78 |

<Production of Toner Particles 6>

Toner by Emulsion Polymerization Method

—Preparation of Resin Particle-Dispersed Liquid 1—

| | |
|---|---|
| Styrene | 75 parts by mass |
| n-butyl acrylate | 25 parts by mass |
| Acrylic acid | 3 parts by mass |

The above components were mixed, and the resultant solution was dispersed and emulsified in a solution prepared by dissolving 1.5 parts by mass of a nonionic surfactant (manufactured by Sanyo Chemical Industries, Ltd.: NONIPOL 400) and 2.2 parts by mass of an anionic surfactant (manufactured by Dai-ichi Kogyo Seiyaku Co., Ltd.: Neogen S.C.) in 120 parts by mass of ion-exchanged water. While the solution was slowly s stirred for 10 minutes, 10 parts by mass of ion-exchange water in which 1.5 parts by mass of ammonium persulfate had been dissolved was charged into the solutions, and the atmosphere was replaced with nitrogen. After that, the contents were heated to 70° C. while being stirred, and then emulsion polymerization was continued for 4 hours without any change. Thus, a resin particle-dispersed liquid 1 in which resin particles having a number average particle diameter of 0.29 μm were dispersed, was prepared.

—Preparation of Resin Particle-Dispersed Liquid 2—

| | |
|---|---|
| Styrene | 40 parts by mass |
| n-butyl acrylate | 58 parts by mass |
| Divinylbenzene | 3 parts by mass |
| Acrylic acid | 3 parts by mass |

The above components were mixed, and the resultant solution was dispersed and emulsified in a solution prepared by dissolving 1.5 parts by mass of a nonionic surfactant (manufactured by Sanyo Chemical Industries, Ltd.: NONIPOL 400) and 2.2 parts by mass of an anionic surfactant (manufactured by Dai-ichi Kogyo Seiyaku Co., Ltd.: Neogen S.C.) in 120 parts by mass of ion-exchange water. While the solution was slowly stirred for 10 minutes, 10 parts by mass of ion-exchange water in which 0.9 part by mass of ammonium persulfate had been dissolved was charged into the solution, and the atmosphere was replaced with nitrogen. After that, the contents were heated to 70° C. while being stirred, and then emulsion polymerization was continued for 4 hours. Thus, a resin particle-dispersed liquid 2 obtained by dispersing resin particles having a number average particle diameter of 0.31 μm was prepared.

—Preparation of Resin Particle-Dispersed Liquid 3—

| | |
|---|---|
| Styrene | 80 parts by mass |
| n-butyl acrylate | 20 parts by mass |
| Divinylbenzene | 0.8 part by mass |
| Acrylic acid | 3 parts by mass |

The above components were mixed, and the resultant solution was dispersed and emulsified in a solution prepared by dissolving 1.5 parts by mass of a nonionic surfactant (manufactured by Sanyo Chemical Industries, Ltd.: NONIPOL 400) and 2.2 parts by mass of an anionic surfactant (manufactured by Dai-ichi Kogyo Seiyaku Co., Ltd.: Neogen S.C.) in 120 parts by mass of ion-exchange water. While the solution was slowly stirred for 10 minutes, 10 parts by mass of ion-exchange water in which 1.2 parts by mass of ammonium persulfate had been dissolved was charged into the solution, and the atmosphere was replaced with nitrogen. After that, the contents were heated to 70° C. while being stirred, and then emulsion polymerization was continued for 4 hours. Thus, a resin particle-dispersed liquid 3 obtained by dispersing resin particles having a number average particle diameter of 0.25 μm was prepared.

—Preparation of Colorant Particle-Dispersed Liquid 1—

| | |
|---|---|
| C.I. Pigment Red 122 | 20 parts by mass |
| Anionic surfactant (Manufactured by Dai-ichi Kogyo Seiyaku Co., Ltd.: Neogen SC) | 3 parts by mass |
| Ion-exchange water | 78 parts by mass |

The above components were mixed, and were then dispersed with a sand grinder mill. The grain size distribution in the colorant particle-dispersed liquid 1 was measured with a grain size measuring apparatus (LA-700 manufactured by HORIBA, Ltd.). As a result, the colorant particles in the liquid had a number average particle diameter of 0.20 μm, and no coarse particles each having a particle diameter in excess of 1 μm were observed.

—Preparation of Release Agent Particle-Dispersed Liquid—

| | |
|---|---|
| Release agent Fischer-Tropsch wax (the peak temperature of the highest endothermic peak = 70° C.) | 50 parts by mass |
| Anionic surfactant (Manufactured by Dai-ichi Kogyo Seiyaku Co., Ltd.: Neogen SC) | 7 parts by mass |
| Ion-exchange water | 200 parts by mass |

The above components were heated to 95° C., and were then dispersed with a homogenizer (manufactured by IKA: Ultraturrax T50). After that, the resultant was subjected to dispersion treatment with a pressure ejection-type homogenizer, whereby a release agent particle-dispersed liquid obtained by dispersing a release agent having a number average particle diameter of 0.50 μm was prepared.

—Preparation of Charge Control Agent Particle-Dispersed Liquid—

| | |
|---|---|
| Metal compound of di-alkyl-salicylic acid (Charge control agent, BONTRON E-84, manufactured by Orient Chemical Industries, Ltd.) | 5 parts by mass |
| Anionic surfactant (Manufactured by Dai-ichi Kogyo Seiyaku Co. Ltd.: Neogen SC) | 3 parts by mass |
| Ion-exchange water | 78 parts by mass |

The above components were mixed, and were then dispersed with a sand grinder mill. The grain size distribution in the charge control agent particle-dispersed liquid 1 was measured with a grain size measuring apparatus (LA-700 manufactured by HORIBA, Ltd.). As a result, the charge control agent particles in the liquid had an average particle diameter of 0.2 μm, and no coarse particles having a particle diameter in excess of 1 μm were observed.

—Preparation of Mixed Liquid—

| | |
|---|---|
| Resin particle-dispersed liquid 1 | 80 parts by mass |
| Resin particle-dispersed liquid 2 | 100 parts by mass |
| Colorant particle-dispersed liquid 1 | 40 parts by mass |
| Release agent particle-dispersed liquid | 70 parts by mass |

The above liquids were charged into a 1-liter separable flask provided with a stirring apparatus, a condenser, and a temperature gauge, and were then stirred. The pH of the mixed liquid was adjusted to 5.2 with a 1-mol/l aqueous solution of potassium hydroxide.

—Formation of Agglomerated Particles—

150 parts by mass of an 8% aqueous solution of sodium chloride as a flocculating agent was dropwise added to the mixed liquid, and the mixture was heated to 55° C. while being stirred. At the temperature, 3 parts by mass of the resin particle-dispersed liquid 3 and 10 parts by mass of the charge control agent particle-dispersed liquid were added to the mixture. After having been held at 55° C. for 2 hours, the resultant was observed with an optical microscope. As a result, the formation of agglomerated particles having a number average particle diameter of about 3.3 μm was observed.

—Melt Adhesion Step—

After the above process, 3 parts by mass of an anionic surfactant (manufactured by Dai-ichi Kogyo Seiyaku Co., Ltd.: Neogen S.C.) was added to the product obtained above, and the resulting mixture was heated to 95° C. while being continuously stirred, and was held at the temperature for 4.5 hours. After cooling, the reaction product was filtrated and sufficiently washed with ion-exchange water. After that, the resulting product was subjected to fluidized bed drying at 45° C. Thereafter, the resultant was further dispersed in a gas phase at 200 to 300° C. with a spray dryer so that the shapes of particles could be adjusted. Thus, toner particles 6 were obtained.

<Production of Toner Particles 7>

Toner by Suspension Granulation Method

—Synthesis of Toner Binder—

660 parts by mass of a 2-mole ethylene oxide adduct of bisphenol A, 100 parts by mass of a 2-mole propylene oxide adduct of bisphenol A, 290 parts by mass of terephthalic acid, and 2.5 parts by mass of dibutyltin oxide were placed in a reaction vessel provided with a condenser, a stirring machine and a nitrogen-introducing pipe, and were subjected to reaction at normal pressure and 220° C. for 12 hours. Further, the resultant was subjected to a reaction under a reduced pressure of 10 to 15 mmHg for 6.5 hours. After that, the resultant was cooled to 190° C., 32 parts by mass of phthalic anhydride was added to the resultant, and was subjected to a reaction for 2 hours. Next, the resultant was cooled to 80° C., and was then reacted with 180 parts by mass of isophorone diisocyanate in ethyl acetate for 2 hours, whereby an isocyanate-containing prepolymer (1) was obtained. Next, 267 parts by mass of the prepolymer (1) and 14 parts by mass of isophorone diamine were reacted with each other at 50° C. for 2 hours, whereby a urea-modified polyester (1) having a weight average molecular weight of 65,000 was obtained. As in the above, 624 parts by mass of an 2-mole ethylene oxide adduct of bisphenol A, 100 parts by mass of a 2-mole propylene oxide adduct of bisphenol A, 138 parts by mass of terephthalic acid, and 138 parts by mass of isophthalic acid were subjected to polycondensation at normal pressure and 230° C. for 5 hours. Next, the resultant was subjected to a reaction under a reduced pressure of 10 to 15 mmHg for 5.5 hours, whereby an unmodified polyester (a) having a peak molecular weight of 6,300 was obtained. 250 parts by mass of the urea-modified polyester (1) and 750 parts by mass of the unmodified polyester (a) were dissolved and mixed in 2,000 parts by mass of tetrahydrofuran, whereby a solution of a toner binder (1) in tetrahydrofuran was obtained.

240 parts by mass of the solution of the toner binder (1) in tetrahydrofuran and 4 parts by mass of a C.I. Pigment Blue 15:3 were placed in a TK-homomixer, and were stirred with the TK-homomixer at 55° C. and 12,000 rpm so as to be uniformly dissolved and dispersed. 706 parts by mass of ion-exchange water, 294 parts by mass of a 10% suspension of hydroxyapatite (Supertite 10 manufactured by Nippon Chemical Industrial Co., Ltd.), and 0.17 part by mass of sodium dodecylbenzenesulfonate were placed in a beaker and uniformly dissolved. Next, the temperature of the resultant solution was increased to 55° C., and the above toner material solution was charged into the solution while the solution was stirred with the TK-homomixer at 12,000 rpm. Then, the mixed liquid was stirred for 10 minutes. Next, the mixed liquid was transferred to a flask (kolben) provided with a stirring rod and a temperature gauge, and its temperature was raised to 98° C. so that the solvent might be removed. The resultant was separated by filtration, washed and dried, and was then subjected to air classification, whereby toner particles 7 were obtained.

<Production of Toner Particles 8>

| Dry method (pulverizing method) toner | |
|---|---|
| Binder resin [Styrene-n-butyl acrylate copolymer resin (Mw = 30,000, Tg = 62° C.)] | 100 parts by mass |
| C.I. Pigment Blue 15:3 | 5 parts by mass |
| Aluminum compound of 3,5-di-tert-butylsalicylic acid [manufactured by Orient Chemical Industries, Ltd.: BONTRON E88] | 3 parts by mass |
| Ester wax [behenyl behenate: the peak temperature of highest endothermic peak = 72° C., Mw = 700] | 6.0 parts by mass |

The above materials were mixed in advance, and the mixture was melted and kneaded with a biaxial extruder. The kneaded product was cooled, and was then pulverized with a hammer mill. The pulverized product was classified, whereby toner particles 8 were obtained.

<Production of Fatty Acid Metal Salt 1>

A receiver provided with a stirring apparatus was prepared, and the stirrer was rotated at 350 rpm. 500 parts by mass of a 0.5-mass % aqueous solution of sodium stearate was charged into the receiver, and the temperature of the solution was adjusted to 85° C. Next, 525 parts by mass of a 0.2-mass % aqueous solution of zinc sulfate was dropwise added to the receiver over 15 minutes. After the completion of the addition of the total amount, the mixture was aged in a temperature state at the time of the reaction for 10 minutes, and the reaction was terminated.

Figure 1:
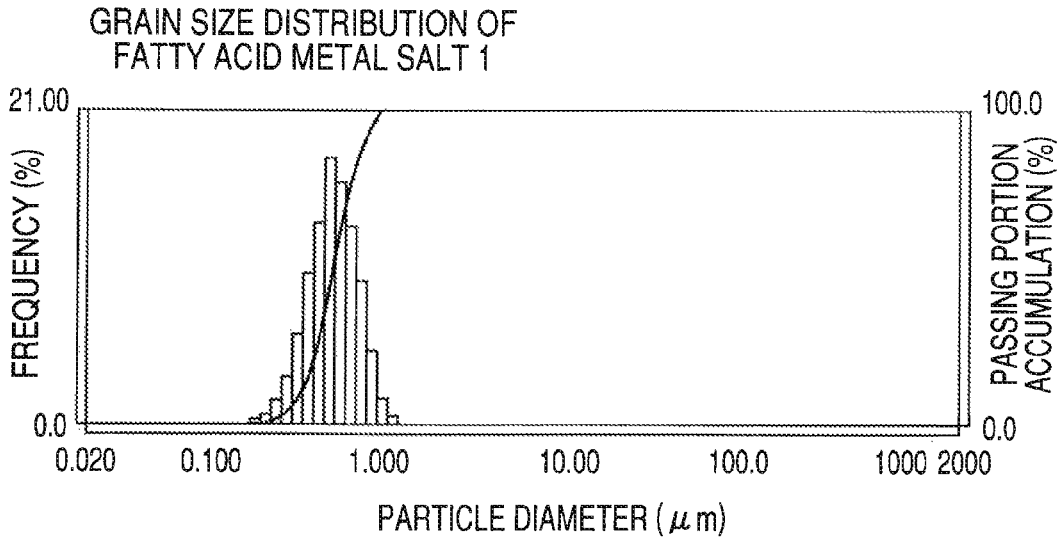
FIG. 1 is a graph showing the grain size distribution of a fatty acid metal salt 1 used in an example of the present invention.

Next, the fatty acid metal salt slurry thus obtained was filtrated and washed. The resultant fatty acid metal salt cake after the washing was coarsely ground, and then the coarsely ground product was dried with a continuous flash dryer at 105° C. After that, the coarsely ground products were pulverized with a Nano Grinding Mill [NJ-300] (manufactured by SUNREX Co., Ltd.) at an airflow rate of 6.0 $m^3$/min and a processing speed of 80 kg/h. After that, the pulverized product were slurried again, and fine and coarse particles were removed by using a wet centrifugal classifier. After that, the remaining particles were dried with a continuous flash dryer at 80° C., whereby fatty acid metal salt fine particles 1 were obtained. The resultant fatty acid metal salt fine particles 1 had a volume-based median diameter (D50s) of 0.45 μm and a span value B of 0.92. Table 2 shows the physical properties of the fatty acid metal salt fine particles 1, and FIG. 1 shows the grain size distribution of the fine particles.

<Production of Fatty Acid Metal Salt 2>

Figure 2:
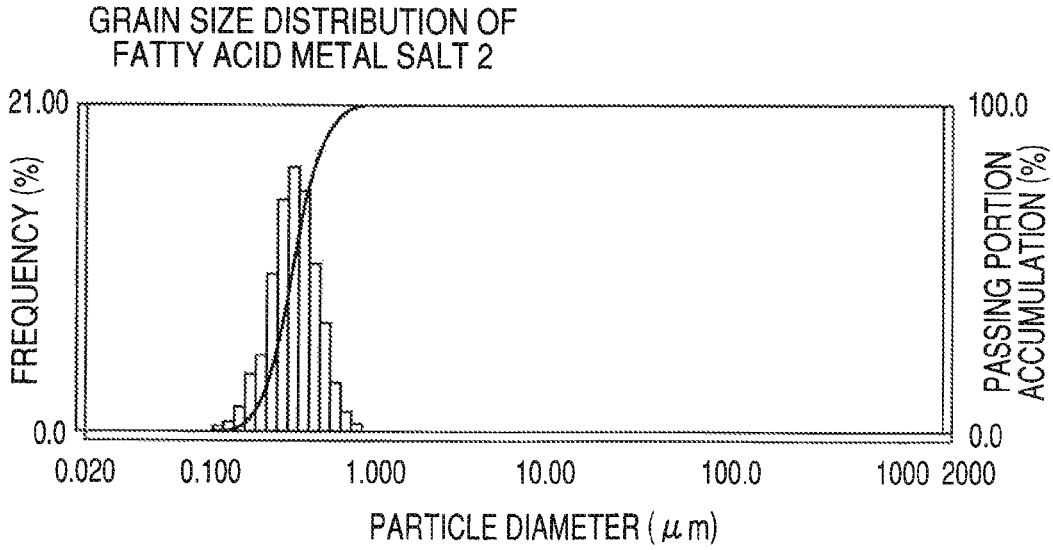
FIG. 2 is a graph showing the grain size distribution of a fatty acid metal salt 2 used in an example of the present invention.

Fatty acid metal salt fine particles 2 were obtained in the same manner as in the production of the fatty acid metal salt 1 except that: the 0.5-mass % aqueous solution of sodium stearate was changed to a 0.25-mass % aqueous solution of sodium stearate; the 0.2-mass % aqueous solution of zinc sulfate was changed to a 0.15-mass % aqueous solution of zinc sulfate. The resultant fatty acid metal salt fine particles 2 had a volume-based median diameter (D50s) of 0.33 μm and a span value B of 0.81. Table 2 shows the physical properties of the fatty acid metal salt fine particles 2, and FIG. 2 shows the grain size distribution of the fine particles <Production of Fatty Acid Metal Salt 3>

Fatty acid metal salt fine particles 3 were obtained in the same manner as in the production of the fatty acid metal salt fine particles 1 except that: the 0.5-mass % aqueous solution of sodium stearate was changed to a 2.0-mass % aqueous solution of sodium stearate; the 0.2-mass % aqueous solution of zinc sulfate was changed to a 1.0-mass % aqueous solution of calcium chloride; and the reaction was terminated by aging for 5 minutes. The resultant fatty acid metal salt fine particles 3 had a volume-based median diameter (D50s) of 0.60 μm and a span value B of 1.51. Table 2 shows the physical properties of the fatty acid metal salt fine particles 3.

<Production of Fatty Acid Metal Salt 4>

Fatty acid metal salt fine particles 4 were obtained in the same manner as in the production of the fatty acid metal salt 1 except that: the 0.5-mass % aqueous solution of sodium stearate was changed to a 0.25-mass % aqueous solution of sodium stearate; the 0.2-mass % aqueous solution of zinc sulfate was changed to a 0.15-mass % aqueous solution of zinc sulfate. In addition, as for the conditions for pulverization, i.e., the airflow rate was changed to 10.0 $m^3$/min, and the pulverizing step was performed three times. The resultant fatty acid metal salt fine particles 4 had a volume-based median diameter (D50s) of 0.18 μm and a span value B of 1.34. Table 2 shows the physical properties of the fatty acid metal salt fine particles 4.

<Production of Fatty Acid Metal Salt 5>

Fatty acid metal salt fine particles 5 were obtained in the same manner as in the production of the fatty acid metal salt fine particles 1 except that: the 0.5-mass % aqueous solution of sodium stearate was changed to a 0.7-mass % aqueous solution of sodium stearate; the 0.2-mass % aqueous solution of zinc sulfate was changed to a 0.3-mass % aqueous solution of zinc sulfate; and as for the conditions for pulverization, the airflow rate was changed to 4.0 $m^3$/min, and the processing speed was charged to 50 kg/h. The resultant fatty acid metal salt fine particles 5 had a volume-based median diameter (D50s) of 0.64 μm and a span value B of 0.98. Table 2 shows the physical properties of the fatty acid metal salt fine particles 5.

<Production of Fatty Acid Metal Salt 6>

In the production of the fatty acid metal salt 1, the 0.5-mass % aqueous solution of sodium stearate was changed to a 1.0-mass % aqueous solution of sodium stearate, and the 0.2-mass % aqueous solution of zinc sulfate was changed to a 0.7-mass % aqueous solution of calcium chloride. In addition, the reaction was terminated by aging for 5 minutes. Further, as for the conditions for pulverization, the airflow rate was changed to 5.0 $m^3$/min. After the pulverixation, fine and coarse particles were removed with an air classfier. Thus, fatty acid metal salt fine particles 6 were obtained. The resultant fatty acid metal salt fine particles 6 had a volume-based median diameter (D50s) of 0.58 μm and a span value B of 1.73. Table 2 shows the physical properties of the fatty acid metal salt fine particles 6.

<Production of Fatty Acid Metal Salt 7>

Fatty acid metal salt fine particles 7 were obtained in the same manner as in the production of the fatty acid metal salt 1 except that the 0.5-mass % aqueous solution of sodium stearate was changed to a 0.5-mass % aqueous solution of sodium laurate. The resultant fatty acid metal salt fine particles 7 had a volume-based median diameter (D50s) of 0.62 μm and a span value B of 1.05. Table 2 shows the physical properties of the fatty acid metal salt fine particles 7.

<Production of Fatty Acid Metal Salt 8>

Fatty acid metal salt fine particles 8 were obtained in the same manner as in the production of the fatty acid metal salt 1 except that the 0.2-mass % aqueous solution of zinc sulfate was changed to a 0.3-mass % aqueous solution of lithium chloride. The resultant fatty acid metal salt fine particles 8 had a volume-based median diameter (D50s) of 0.33 μm and a span value B of 0.85. Table 2 shows the physical properties of the fatty acid metal salt fine particles 8.

<Production of Fatty Acid Metal Salt 9>

Fatty acid metal salt fine particles 9 were obtained in the same manner as in the production of the fatty acid metal salt fine particles 1 except that: the 0.5-mass % aqueous solution of sodium stearate was changed to a 1.0-mass % aqueous solution of sodium stearate; the 0.2-mass % aqueous solution of zinc sulfate was changed to a 0.4-mass % aqueous solution of zinc sulfate; the reaction was terminated by aging for 15 minutes; and as for the conditions for pulverization, the airslow rate was changed to 4.0 $m^3$/min. The resultant fatty acid metal salt fine particles 9 had a volume-based median diameter (D50s) of 0.72 μm and a span value B of 1.26. Table 2 shows the physical properties of the fatty acid metal salt fine particles 9.

<Production of Fatty Acid Metal Salt 10>

In the production of the fatty acid metal salt 1, the 0.5-mass % aqueous solution of sodium stearate was changed to a 0.05-mass % aqueous solution of sodium stearate. In addition, the 0.2-mass % aqueous solution of zinc sulfate was changed to a 0.02-mass % aqueous solution of zinc sulfate. In addition, as for conditions for pulverization, the air quantity was changed to 10.0 $m^3$/min, and the pulverizing step was performed three times. After that, no classifying step was performed, and coarse particles were removed by passing the resultant particles through a mesh. Thus, fatty acid metal salt fine particles 10 were obtained. The resultant fatty acid metal salt fine particles 10 had a volume-based median diameter (D50s) of 0.12 μm and a span value B of 1.70. Table 2 shows the physical properties of the fatty acid metal salt fine particles 10.

<Fatty Acid Metal Salt 11>

Figure 3:
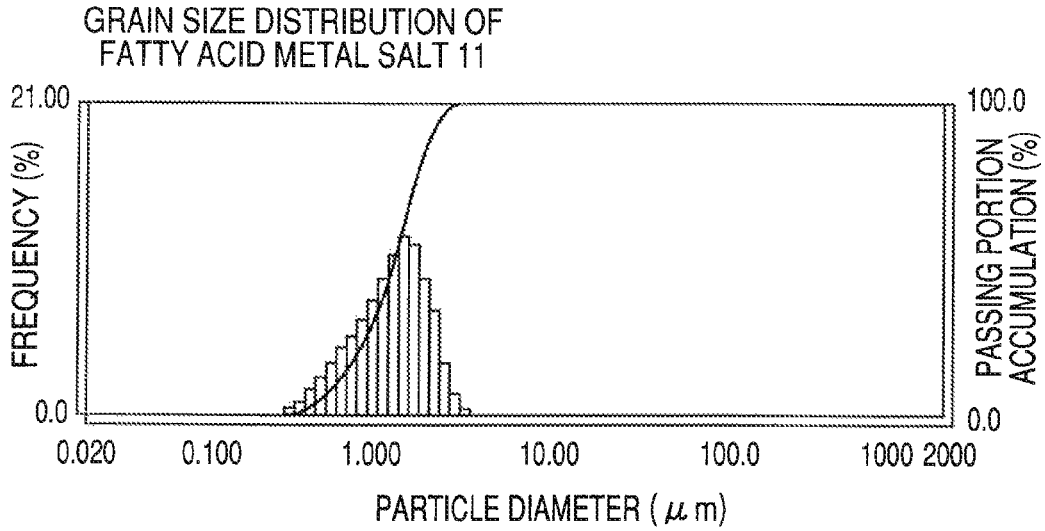
FIG. 3 is a graph showing the grain size distribution of a fatty acid metal salt 11 used in a comparative example of the present invention.

Commercially available zinc stearate (MZ2 manufactured by NIHONYUSHI K.K.) was defined as a fatty acid metal salt 11. The fatty acid metal salt 11 had a volume-based median diameter (D50s) of 1.29 μm and a span value B of 1.61. Table 2 shows the physical properties of the fatty acid metal salt 11, and FIG. 3 shows the grain size distribution of the fatty acid metal salt.

<Fatty Acid Metal Salt 12>

Figure 4:
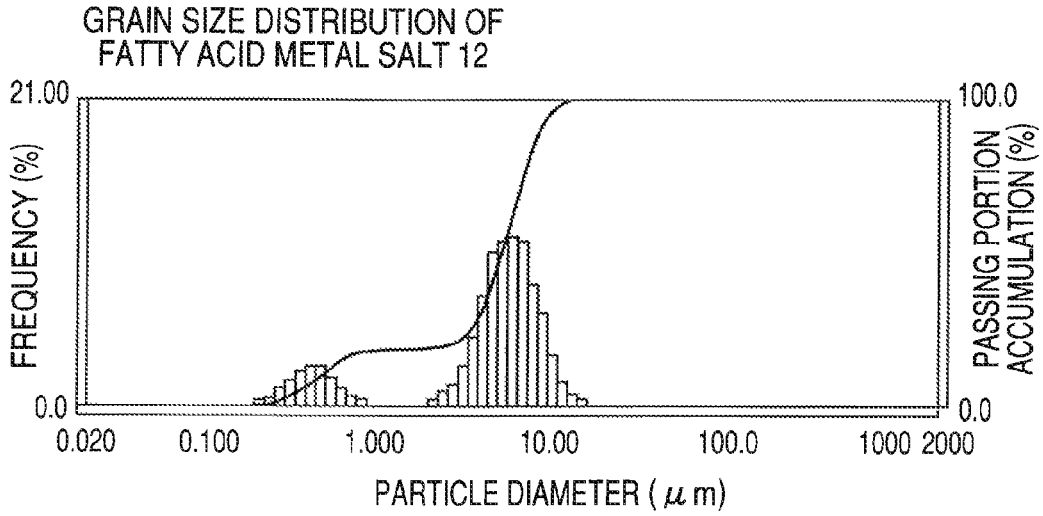
FIG. 4 is a graph showing the grain size distribution of a fatty acid metal salt 12 used in a comparative example of the present invention.
Figure 5:
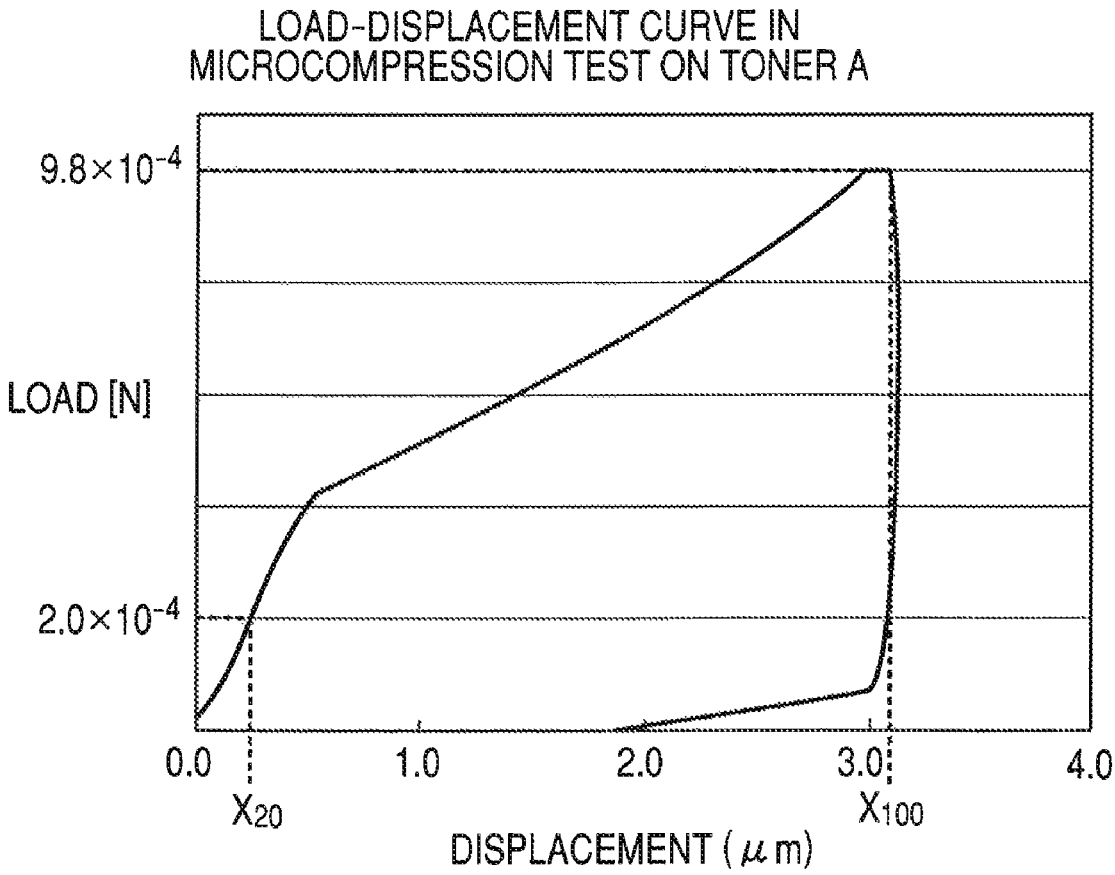
FIG. 5 is a graph showing a load-displacement curve in a microcompression test on Toner A used in an example of the present invention.

Commercially available zinc stearate (SZ2000 manufactured by Sakai Chemical Industry Co., Ltd.) was defined as a fatty acid metal salt 12. The fatty acid metal salt 12 had a volume-based median diameter (D50s) of 5.30 μm and a span value B of 1.84. Table 2 shows the physical properties of the fatty acid metal salt 12, and FIG. 4 shows the grain size distribution of the fatty acid metal salt.

TABLE 2

| | Kind | Number of carbon atoms of fatty acid | D50s (μm) | Span value B | Amount of free fatty acid (%) |
|---|---|---|---|---|---|
| Fatty acid metal salt 1 | Zinc stearate | 18 | 0.45 | 0.92 | 0.11 |
| Fatty acid metal salt 2 | Zinc stearate | 18 | 0.33 | 0.81 | 0.18 |
| Fatty acid metal salt 3 | Calcium stearate | 18 | 0.60 | 1.51 | 0.15 |
| Fatty acid metal salt 4 | Zinc stearate | 18 | 0.18 | 1.34 | 0.09 |
| Fatty acid metal salt 5 | Zinc stearate | 18 | 0.64 | 0.98 | 0.15 |
| Fatty acid metal salt 6 | Calcium stearate | 18 | 0.58 | 1.73 | 0.21 |
| Fatty acid metal salt 7 | Zinc laurate | 12 | 0.62 | 1.05 | 0.60 |
| Fatty acid metal salt 8 | Lithium stearate | 18 | 0.33 | 0.85 | 0.32 |
| Fatty acid metal salt 9 | Zinc stearate | 18 | 0.72 | 1.26 | 0.10 |
| Fatty acid metal salt 10 | Zinc stearate | 18 | 0.12 | 1.70 | 0.15 |
| Fatty acid metal salt 11 | Zinc stearate | 18 | 1.29 | 1.61 | 0.13 |
| Fatty acid metal salt 12 | Zinc stearate | 18 | 5.30 | 1.84 | 0.12 |

Toner Production Example 1

0.10 part by mass of the fatty acid metal salt 1 and 1.5 parts by mass of a hydrophobic silica fine powder subjected to surface treatment with hexamethyldisilazane (number average primary particle diameter: 10 nm) were added to 100 parts by mass of the toner particles 1, and were mixed with a HENSCHEL MIXER (manufactured by MITSUI MINING. CO., LTD.) for 150 seconds (mixing step 1). After that, the operation was caused to pause for 120 seconds (pausing step 1). Further, a mixing step for 150 seconds and a pausing step for 120 seconds were alternately repeated (mixing step 2→pausing step 2→mixing step 3→pausing step 3→mixing step 4). The maximum temperature in the tank achieved by repeating the mixing steps and the pausing steps as described above was about 34° C. A toner thus obtained was defined as Toner (A). Table 3 shows the physical properties of Toner (A) thus obtained.

Toner Production Example 2

Toner (B) was obtained in the same manner as in Toner Production Example 1 except that the production was completed at the mixing step 3. The maximum temperature in the tank thus achieved was about 33° C. Table 3 shows the physical properties of Toner (B) thus obtained.

Toner Production Example 3

Toner (C) was obtained in the same manner as in Toner Production Example 1 except that the time period for the mixing step was changed to 200 seconds, and the time period for the pausing step was changed to 180 seconds. The maximum temperature in the tank thus achieved was about 37° C. Table 3 shows the physical properties of Toner (C) thus obtained.

Toner Production Example 4

Toner (D) was obtained in the same manner as in Toner Production Example 1 except that: the time period for the mixing step was changed to 200 seconds; a time period for the pausing step was changed to 180 seconds; and the production was completed at the mixing step 2. The maximum temperature in the tank thus achieved was about 35° C. Table 3 shows the physical properties of Toner (D) thus obtained.

Toner Production Example 5

Toner (E) was obtained in the same manner as in Toner Production Example 1 except that: the time period for each of the first, second, and third mixing steps was changed to 200 seconds; the time period for the fourth mixing step was changed to 300 seconds; and the time period for the pausing step was changed to 60 seconds. The maximum temperature in the tank thus achieved was about 39° C. Table 3 shows the physical properties of Toner (E) thus obtained.

Toner Production Example 6

Toner (F) was obtained in the same manner as in Toner Production Example 1 except that: the fatty acid metal salt 1 was changed to the fatty acid metal salt 2; and the time period for the mixing step was changed to 10 minutes while no pausing step was provided so that the mixing step was completed at one try. Table 3 shows the physical properties of Toner (F) thus obtained.

Toner Production Example 7

Toner (G) was obtained in the same manner as in Toner Production Example 1 except that: the fatty acid metal salt 1 was changed to the fatty acid metal salt 3; and the time period for the mixing step was changed to 4 minutes while no pausing step was provided so that the mixing step was completed at one try. Table 3 shows the physical properties of Toner (G) thus obtained.

Toner Production Example 8

Toner (H) was obtained in the same manner as in Toner Production Example 1 except that the fatty acid metal salt 1 was changed to the fatty acid metal salt 4. Table 3 shows the physical properties of Toner (H) thus obtained.

Toner Production Example 9

Toner (I) was obtained in the same manner as in Toner Production Example 1 except that the fatty acid metal salt 1 was changed to the fatty acid metal salt 5. Table 3 shows the physical properties of Toner (I) thus obtained.

Toner Production Example 10

Toner (J) was obtained in the same manner as in Toner Production Example 1 except that the amount of the fatty acid metal salt 1 to be added was changed from 0.10 part by mass to 0.05 part by mass. Table 3 shows the physical properties of Toner (J) thus obtained.

Toner Production Example 11

Toner (K) was obtained in the same manner as in Toner Production Example 1 except that the amount of the fatty acid metal salt 1 to be added was changed from 0.10 part by mass to 0.30 part by mass. Table 3 shows the physical properties of Toner (K) thus obtained.

Toner Production Example 12

Toner (L) was obtained in the same manner as in Toner Production Example 1 except that: the amount of the fatty acid metal salt 1 to be added was changed from 0.01 part by mass to 0.30 part by mass; the time period for the mixing step was changed to 200 seconds; the time period for the pausing step was changed to 180 seconds; and the production was completed at the mixing step 2. Table 3 shows the physical properties of Toner (L) thus obtained.

Toner Production Example 13

Toner (M) was obtained in the same manner as in Toner Production Example 1 except that: the amount of the fatty acid metal salt 1 to be added was changed from 0.10 part by mass to 0.55 part by mass. Table 3 shows the physical properties of Toner (M) thus obtained.

Toner Production Example 14

Toner (N) was obtained in the same manner as in Toner Production Example 1 except that the fatty acid metal salt 1 was changed to a fatty acid metal salt 6. Table 3 shows the physical properties of Toner (N) thus obtained.

Toner Production Example 15

Toner (O) was obtained in the same manner as in Toner Production Example 1 except that the fatty acid metal salt 1 was changed to a fatty acid metal salt 7. Table 3 shows physical properties of Toner (O) thus obtained.

Toner Production Example 16

Toner (P) was obtained in the same manner as in Toner Production Example 1 except that the fatty acid metal salt 1 was changed to the fatty acid metal salt 8. Table 3 shows the physical properties of Toner (P) thus obtained.

Toner Production Example 17

Toner (Q) was obtained in the same manner as in Toner Production Example 1 except that the toner particles 1 were changed to toner particles 2 and the amount of the fatty acid metal salt 1 to be added was changed to 0.2 part by mass. Table 3 shows the physical properties of Toner (Q) thus obtained.

Toner Production Example 18

Toner (R) was obtained in the same manner as in Toner Production Example 1 except that the toner particles 1 were changed to toner particles 3. Table 3 shows the physical properties of Toner (R) thus obtained.

Toner Production Example 19

Toner (S) was obtained in the same manner as in Toner Production Example 1 except that the toner particles 1 were changed to toner particles 4. Table 3 shows the physical properties of Toner (S) thus obtained.

Toner Production Example 20

Toner (T) was obtained in the same manner as in Toner Production Example 1 except that the toner particles 1 were changed to toner particles 5. Table 3 shows the physical properties of Toner (T) thus obtained.

Toner Production Example 21

Toner (U) was obtained in the same manner as in Toner Production Example 1 except that the toner particles 1 were changed to toner particles 6. Table 3 shows the physical properties of Toner (U) thus obtained.

Toner Production Example 22

Toner (V) was obtained in the same manner as in Toner Production Example 1 except that the toner particles 1 were changed to toner particles 6 and the fatty acid metal salt 1 was changed to the fatty acid metal salt 3. Table 3 shows the physical properties of Toner (V) thus obtained.

Toner Production Example 23

Toner (W) was obtained in the same manner as in Toner Production Example 1 except that the toner particles 1 were changed to toner particles 7. Table 3 shows the physical properties of Toner (W) thus obtained.

Toner Production Example 24

Toner (X) was obtained in the same manner as in Toner Production Example 1 except that the toner particles 1 were changed to toner particles 8. Table 3 shows the physical properties of Toner (X) thus obtained.

Toner-for-Comparative-Example Production Example 1

Toner (a) was obtained in the same manner as in Toner Production Example 1 except that the fatty metal salt 1 was changed to the fatty metal salt 9. Table 3 shows physical properties of the obtained Toner (a).

Toner-for-Comparative-Example Production Example 2

Toner (b) was obtained in the same manner as in Toner Production Example 1 except that the fatty acid metal salt 1 was changed to the fatty acid metal salt 10. Table 3 shows physical properties of the obtained Toner (b).

Toner-for-Comparative-Example Production Example 3

Toner (c) was obtained in the same manner as in Toner Production Example 2 except that the fatty acid metal salt 1 was changed to the fatty acid metal salt 11. Table 3 shows physical properties of the obtained Toner (c).

Toner-for-Comparative-Example Production Example 4

Toner (d) was obtained in the same manner as in Toner Production Example 1 except that the fatty acid metal salt 1 was changed to the fatty acid metal salt 12. Table 3 shows physical properties of the obtained Toner (d).

Toner-for-Comparative-Example Production Example 5

Toner (e) was obtained in the same manner as in Toner Production Example 1 except that: the toner particles 1 were changed to the toner particles 6; the fatty acid metal salt 1 was changed to the fatty acid metal salt 5; and the time period for the mixing step was changed to 400 seconds while no pausing step was provided so that the mixing step might be completed at one try. The maximum temperature in the tank thus achieved was about 41° C. Table 3 shows the physical properties of Toner (e) thus obtained.

Toner-for-Comparative-Example Production Example 6

Toner (f) was obtained in the same manner as in Toner Production Example 1 except that: the toner particles 1 were changed to the toner particles 7; the fatty acid metal salt 1 was changed to the fatty acid metal salt 4; the mixer was changed from the Henschel mixer (manufactured by MITSUI MINING. CO., LTD.) to a Mechano Hybrid [MH type] (manufactured by MITSUI MINING. CO., LTD.); and the mixing time was changed to 400 seconds while no pausing step was provided so that the mixing step might be completed at one try. The maximum temperature in the tank thus achieved was about 45° C. It should be noted that the Mechano Hybrid [Model MH] is an apparatus which: has a higher throughput than the Henschel mixer; and can adhere an additive to each toner particle more strongly than the Henschel mixer. Table 3 shows the physical properties of Toner (f) thus obtained.

Toner-for-Comparative-Example Production Example 7

Toner (g) was obtained in the same manner as in Toner Production Example 1 except that: the fatty acid metal salt 1 was changed to the fatty acid metal salt 5; and the time period for the mixing step was changed to 400 seconds while no pausing step was provided so that the mixing step might be completed at one try. The maximum temperature in the tank thus achieved was about 40° C. Table 3 shows the physical properties of Toner (g) thus obtained.

TABLE 3

| | Toner particles | | Fatty acid metal salt | | Toner | | | | | | | |
|---|---|---|---|---|---|---|---|---|---|---|---|---|
| | No. | Production method | No. | Parts by mass | D1 (μm) | Span value A | $R_{100}$ | $R_{20}$ | Viscosity at 100° C. (Pa · s) | Average circularity | Span value ratio (A/B) | Liberation ratio (%) |
| Toner A | 1 | Suspension polymerization | 1 | 0.10 | 5.1 | 0.55 | 0.55 | 0.040 | 31,000 | 0.982 | 0.60 | 12.3 |
| Toner B | 1 | Suspension polymerization | 1 | 0.10 | 5.1 | 0.55 | 0.55 | 0.040 | 31,000 | 0.982 | 0.60 | 20.2 |
| Toner C | 1 | Suspension polymerization | 1 | 0.10 | 5.1 | 0.55 | 0.55 | 0.040 | 31,000 | 0.982 | 0.60 | 2.8 |
| Toner D | 1 | Suspension polymerization | 1 | 0.10 | 5.1 | 0.55 | 0.55 | 0.040 | 31,000 | 0.982 | 0.60 | 24.3 |
| Toner E | 1 | Suspension polymerization | 1 | 0.10 | 5.1 | 0.55 | 0.55 | 0.040 | 31,000 | 0.982 | 0.68 | 1.4 |
| Toner F | 1 | Suspension polymerization | 2 | 0.10 | 5.1 | 0.55 | 0.55 | 0.040 | 31,000 | 0.982 | 0.36 | 14.3 |
| Toner G | 1 | Suspension polymerization | 3 | 0.10 | 5.1 | 0.55 | 0.55 | 0.040 | 31,000 | 0.982 | 0.41 | 16.4 |
| Toner H | 1 | Suspension polymerization | 4 | 0.10 | 5.1 | 0.55 | 0.55 | 0.040 | 31,000 | 0.982 | 0.56 | 6.5 |
| Toner I | 1 | Suspension polymerization | 5 | 0.10 | 5.1 | 0.55 | 0.55 | 0.040 | 31,000 | 0.982 | 0.60 | 21.2 |
| Toner J | 1 | Suspension polymerization | 1 | 0.05 | 5.1 | 0.55 | 0.55 | 0.040 | 31,000 | 0.982 | 0.60 | 2.2 |
| Toner K | 1 | Suspension polymerization | 1 | 0.30 | 5.1 | 0.55 | 0.55 | 0.040 | 31,000 | 0.982 | 0.60 | 19.7 |
| Toner L | 1 | Suspension polymerization | 1 | 0.02 | 5.1 | 0.55 | 0.55 | 0.040 | 31,000 | 0.982 | 0.60 | 1.6 |
| Toner M | 1 | Suspension polymerization | 1 | 0.55 | 5.1 | 0.55 | 0.55 | 0.040 | 31,000 | 0.982 | 0.60 | 23.2 |
| Toner N | 1 | Suspension polymerization | 6 | 0.10 | 5.1 | 0.55 | 0.55 | 0.040 | 31,000 | 0.982 | 0.33 | 8.6 |
| Toner O | 1 | Suspension polymerization | 7 | 0.10 | 5.1 | 0.55 | 0.55 | 0.040 | 31,000 | 0.982 | 0.52 | 10.6 |
| Toner P | 1 | Suspension polymerization | 8 | 0.10 | 5.1 | 0.55 | 0.55 | 0.040 | 31,000 | 0.982 | 0.65 | 14.3 |
| Toner Q | 2 | Suspension polymerization | 1 | 0.10 | 5.8 | 0.65 | 0.41 | 0.030 | 44,000 | 0.979 | 0.71 | 11.2 |
| Toner R | 3 | Suspension polymerization | 1 | 0.10 | 6.3 | 0.52 | 0.71 | 0.055 | 22,000 | 0.985 | 0.57 | 15.3 |
| Toner S | 4 | Suspension polymerization | 1 | 0.10 | 6.2 | 0.45 | 0.22 | 0.017 | 67,000 | 0.987 | 0.49 | 13.8 |
| Toner T | 5 | Suspension polymerization | 1 | 0.10 | 5.3 | 0.59 | 0.88 | 0.072 | 11,000 | 0.986 | 0.64 | 11.5 |
| Toner U | 6 | Emulsion polymerization | 1 | 0.10 | 5.7 | 0.35 | 0.12 | 0.020 | 52,000 | 0.955 | 0.38 | 10.5 |
| Toner V | 6 | Emulsion polymerization | 3 | 0.10 | 5.7 | 0.35 | 0.12 | 0.020 | 52,000 | 0.955 | 0.23 | 18.5 |
| Toner W | 7 | Suspension granulation | 1 | 0.10 | 6.0 | 0.66 | 0.35 | 0.065 | 83,000 | 0.965 | 0.72 | 7.6 |
| Toner X | 8 | Dry method | 1 | 0.10 | 7.5 | 0.90 | 0.49 | 0.111 | 58,000 | 0.938 | 0.98 | 14.8 |
| Toner a | 1 | Suspension polymerization | 9 | 0.10 | 5.1 | 0.55 | 0.55 | 0.040 | 31,000 | 0.982 | 0.44 | 22.1 |
| Toner b | 1 | Suspension polymerization | 10 | 0.10 | 5.1 | 0.55 | 0.55 | 0.040 | 31,000 | 0.982 | 0.32 | 11.7 |
| Toner c | 1 | Suspension polymerization | 11 | 0.10 | 5.1 | 0.55 | 0.55 | 0.040 | 31,000 | 0.982 | 0.34 | 25.3 |
| Toner d | 1 | Suspension polymerization | 12 | 0.10 | 5.1 | 0.55 | 0.55 | 0.040 | 31,000 | 0.982 | 0.30 | 33.5 |
| Toner e | 6 | Emulsion polymerization | 5 | 0.10 | 5.7 | 0.37 | 0.12 | 0.020 | 52,000 | 0.955 | 0.38 | 27.8 |
| Toner f | 7 | Suspension granulation | 4 | 0.10 | 6.0 | 0.66 | 0.35 | 0.065 | 83,000 | 0.965 | 0.49 | 0.7 |
| Toner g | 1 | Suspension polymerization | 5 | 0.10 | 5.1 | 0.55 | 0.55 | 0.040 | 31,000 | 0.982 | 0.56 | 26.8 |

(Image Evaluation)

A commercially available color laser printer HP Color LASERJET 4700dn (manufactured by Hewlett-Packard Company) was prepared, and was modified as described below before image evaluation was performed: a process speed was changed to 200 mm/s, and a fixation temperature was made settable to an arbitrary temperature. Further, the printer was modified so as to be capable of operating even when only a process cartridge for one color was mounted.

The toner in a commercially available black cartridge was removed, and the inside of the cartridge was cleaned by air blowing. After that, the above test toner (300 g) was placed in the cartridge, and was evaluated under both a low-temperature, low-humidity environment (15° C., 10% RH) and a high-temperature, high-humidity environment (40° C., 60% RH).

[Low-Temperature Fixability]

An unfixed solid image (toner laid-on level: 0.6 mg/cm$^2$) was formed on a transfer material. After that, the image was fixed while fixation temperature was changed (125 to 135° C.). Evaluation was made for low-temperature fixability by visual observation of the fixed image. It should be noted that the fixation temperature is a value obtained by measuring the temperature of the surface of a fixing roller with a non-contact temperature gauge. XEROX 4024 letter-sized paper (manufactured by XEROX CORPORATION, 75 g/m$^2$) was used as the transfer material.

A: No offset occurs at 125° C.
B: Offset occurs at 125° C.
C: Offset occurs at 130° C.
D: Offset occurs at 135° C.

Figure 7:
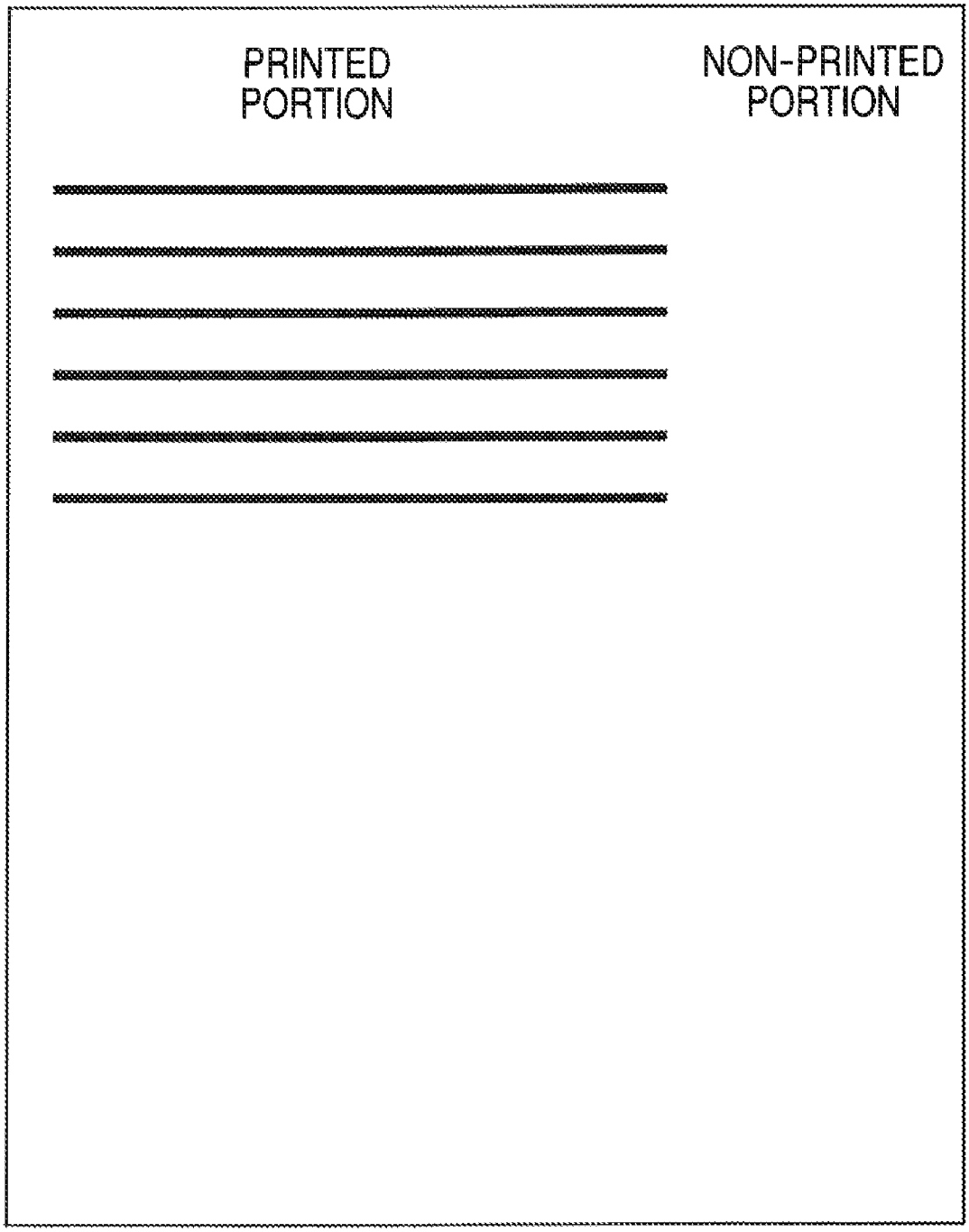
FIG. 7 is a view showing an image formed of horizontal lines at a print percentage of 1%.

Next, a print-out test for printing such an image having a print percentage of 1% as shown in FIG. 7 was performed, and evaluation was made before the print-out test (initial stage), when the image was printed out on 20,000 sheets, and when the image was printed out on 40,000 sheets.

[Resolution]

A small-diameter, isolated, one-dot image at 600 dpi which was difficult to reproduce because the electric field was apt to be shut off by a latent image electric field, was formed on a transfer material, and evaluation was made for resolution on the basis of the reproducibility of the image. XEROX 4024 letter-sized paper (manufactured by XEROX CORPORATION, 75 g/m$^2$) was used as the transfer material.

A: The number of lost dots in 100 isolated dots is less than 5.
B: The number of lost dots in 100 isolated dots is 5 or more and less than 10.
C: The number of lost dots in 100 isolated dots is 10 or more and less than 20.
D: The number of lost dots in 100 isolated dots is 20 or more.

[Transferability]

Transfer residual toner on a photosensitive member after a solid black image had been transferred onto paper was stripped off MYLAR tape. Then, evaluation was made for transferability on the basis of a numerical value obtained by subtracting the Macbeth density on paper to which an unused MYLAR tape had been stuck from the Macbeth density on paper to which the MYLAR tape used for stripping off the transfer residual toner had been stuck. XEROX 4024 letter-sized paper (manufactured by XEROX CORPORATION, 75 g/m$^2$) was used as the transfer material.

A: Less than 0.05.
B: 0.05 or more and less than 0.10.
C: 0.10 or more and less than 0.20.
D: 0.20 or more.

[Image Density Stability]

A solid image (toner laid-on level: 0.6 mg/cm$^2$) was continuously printed on three sheets of paper at each of the initial stage, a time point after the completion of a 20,000-sheet print-out test, and a time point after the completion of a 40,000-sheet print-out test, and evaluation was made for image density stability on the basis of the difference in image density between the first sheet and the third sheet. It should be noted that the image density was relative density measured in relation to a printed-out image at a white portion having an original density of 0.00 by means of "Macbeth reflection densitometer RD918" (manufactured by Macbeth Co.). An A4-sized CLC paper (manufactured by Canon Inc., 80 g/m$^2$) was used as a transfer material.

A: Less than 0.03.
B: 0.03 or more and less than 0.05.
C: 0.05 or more and less than 0.10.
D: 0.10 or more.

[Fogging]

The reflectance (%) of the non-image portion of a printed-out image was measured by means of "REFLECTOMETER MODEL TC-6DS" (manufactured by Tokyo Denshoku CO., LTD.). Evaluation was made for fogging on the basis of a numerical value (%) obtained by subtracting the resultant reflectance from the reflectance (%) of unused transfer paper (plain paper) measured in the same way. The smaller the numerical value, the better the image fogging is suppressed. XEROX 4024 letter-sized paper (manufactured by XEROX CORPORATION, 75 g/m$^2$) was used as the transfer material.

A: Less than 0.5%.
B: 0.5% or more and less than 1.0%.
C: 1.0% or more and less than 3.0%.
D: 3.0% or more.

[Development Stripe]

A halftone image (toner laid-on level: 0.2 mg/cm$^2$) was printed out on transfer paper (75 g/m$^2$, A4-sized paper) at each of the initial stage, a time point after the completion of a 20,000-sheet print-out test, and a time point after the completion of a 40,000-sheet print-out test, and evaluation was made on the basis of the number of portions at which development stripes occurred.

A: No stripes occur.
B: Stripes occur at one or more and three or less portions.
C: Stripes occur at four or more and six or less portions.
D: Stripes occur at seven or more portions, or a stripe having a width of 0.5 mm or more occurs.

[Gloss Evaluation]

The gloss of a solid image (toner laid-on level: 0.6 mg/cm$^2$) fixed at a fixation temperature of 170° C. was measured by means of PG-3D (manufactured by NIPPON DENSHOKU INDUSTRIES CO., LTD.).

A: The gloss is 30 or more and less than 40.
B: The gloss is 20 or more and less than 30.
C: The gloss is 15 or more and less than 20.
D: The gloss is less than 15.

[Filming]

Evaluation for filming on a toner bearing member was performed as described below. A halftone image was printed out at each of the initial stage, a time point after the completion of printing on 20,000 sheets, and a time point after the completion of printing on 40,000 sheets, and whether density unevenness occurred between a portion corresponding to an image portion and a portion corresponding to a non-image portion in an image output test was visually evaluated. After that, the toner on the surface of the toner bearing member was blown off with air, and the surface of the toner bearing member was observed.

A: No density unevenness occurs on the image, and the surface of the toner bearing member is good.

B: No density unevenness occurs on the image, but slight filming on the surface of the toner bearing member is observed.

C: Slight density unevenness occurs on the image.

D: Remarkable density unevenness occurs on the image.

Examples 1 to 12, 14, 16 to 21, and 23, Reference Examples 1 to 4, and Comparative Examples 1 to 7

The above evaluations were performed by using Toners A to L, N, P to U, and W in Examples 1 to 12, 14, 16 to 21, and 23, Toners M, O, V, and X in Reference Examples 1 to 4, and Toners a to g in Comparative Examples 1 to 7. Tables 4 and 5 show the evaluation results.

TABLE 4

| 10° C./15% RH (Low-temperature, low-humidity) | | | | | | | | | | | | | | |
|---|---|---|---|---|---|---|---|---|---|---|---|---|---|---|
| | | | Resolution | | | Transferability | | | Image density stability | | | Fogging | | |
| | Toner | Low-temperature fixability | Initial stage | After printing on 20,000 sheets | After printing on 40,000 sheets | Initial stage | After printing on 20,000 sheets | After printing on 40,000 sheets | Initial stage | After printing on 20,000 sheets | After printing on 40,000 sheets | Initial stage | After printing on 20,000 sheets | After printing on 40,000 sheets |
| Example 1 | A | A | A | A | A | A | A | A | A | A | A | A | A | A |
| Example 2 | B | A | A | A | A | A | A | A | A | A | A | A | A | A |
| Example 3 | C | A | A | A | A | A | A | A | A | A | A | A | A | A |
| Example 4 | D | A | A | A | A | A | A | A | A | A | A | A | A | B |
| Example 5 | E | A | A | A | A | A | A | A | A | A | A | A | A | A |
| Example 6 | F | A | A | A | A | A | A | A | A | A | B | A | A | A |
| Example 7 | G | A | A | A | A | A | A | A | A | A | A | A | A | B |
| Example 8 | H | A | A | A | A | A | A | A | A | A | A | A | A | A |
| Example 9 | I | A | A | A | A | A | A | A | A | A | A | A | A | B |
| Example 10 | J | A | A | A | A | A | A | A | A | A | A | A | A | A |
| Example 11 | K | A | A | A | A | A | A | A | A | A | A | A | A | A |
| Example 12 | L | A | A | A | A | A | A | A | A | A | A | A | A | A |
| Reference Example 1 | M | A | A | A | A | A | A | A | A | A | A | A | B | B |
| Example 14 | N | A | A | A | A | A | A | A | A | A | A | A | A | B |
| Reference Example 2 | O | A | A | A | A | A | A | A | A | A | A | A | A | C |
| Example 16 | P | A | A | A | A | A | A | A | A | A | B | A | A | A |
| Example 17 | Q | A | A | A | A | A | A | A | A | A | A | A | A | B |
| Example 18 | R | A | A | A | A | A | A | A | A | A | A | A | A | A |
| Example 19 | S | C | A | A | B | A | A | A | A | A | A | A | A | B |
| Example 20 | T | A | A | B | B | A | B | B | A | A | A | A | A | A |
| Example 21 | U | B | A | A | A | A | A | B | A | A | A | A | A | B |
| Reference Example 3 | V | B | A | A | A | A | A | A | A | A | A | A | B | B |
| Example 23 | W | A | A | A | B | A | A | B | A | A | A | A | A | A |
| Reference Example 4 | X | A | A | A | B | A | B | B | A | B | B | A | A | A |
| Comparative Example 1 | a | A | A | A | A | A | A | A | A | A | A | A | A | B |
| Comparative Example 2 | b | A | A | A | A | A | A | A | A | A | A | A | B | B |
| Comparative Example 3 | C | A | A | A | A | A | A | A | A | A | A | A | B | B |
| Comparative Example 4 | d | A | A | A | A | A | A | A | A | A | B | A | B | C |
| Comparative Example 5 | e | B | A | A | A | A | A | A | A | A | B | A | B | B |
| Comparative Example 6 | f | A | A | A | B | A | A | B | A | B | B | A | A | A |
| Comparative Example 7 | G | A | A | A | A | A | A | A | A | A | A | A | B | B |

| | Development stripe | | | Gloss | | | Filming | | |
|---|---|---|---|---|---|---|---|---|---|
| | Initial stage | After printing on 20,000 sheets | After printing on 40,000 sheets | Initial stage | After printing on 20,000 sheets | After printing on 40,000 sheets | Initial stage | After printing on 20,000 sheets | After printing on 40,000 sheets |
| Example 1 | A | A | A | A | A | A | A | A | A |
| Example 2 | A | A | A | A | A | A | A | A | A |
| Example 3 | A | A | A | A | A | A | A | A | A |
| Example 4 | A | A | A | A | A | A | A | A | A |
| Example 5 | A | A | A | A | A | A | A | B | B |
| Example 6 | A | A | A | A | A | A | A | A | B |
| Example 7 | A | A | A | A | A | A | A | A | A |
| Example 8 | A | A | A | A | A | A | A | B | B |

TABLE 4-continued

| 10° C./15% RH (Low-temperature, low-humidity) | | | | | | | | | |
|---|---|---|---|---|---|---|---|---|---|
| Example 9 | A | A | A | A | A | A | A | A | B |
| Example 10 | A | A | A | A | A | A | A | A | A |
| Example 11 | A | A | A | A | A | A | A | A | A |
| Example 12 | A | A | A | A | A | A | A | B | C |
| Reference Example 1 | A | A | A | A | A | A | A | A | A |
| Example 14 | A | A | A | A | A | A | A | A | A |
| Reference Example 2 | A | A | A | A | A | A | A | A | A |
| Example 16 | A | A | A | A | A | A | A | A | C |
| Example 17 | A | A | A | A | A | A | A | A | A |
| Example 18 | A | A | A | A | A | A | A | A | A |
| Example 19 | A | A | A | B | B | B | A | A | A |
| Example 20 | A | A | A | A | A | A | A | A | C |
| Example 21 | A | B | B | B | B | B | A | A | A |
| Reference Example 3 | A | B | B | B | B | B | A | A | A |
| Example 23 | A | A | A | A | A | A | A | A | B |
| Reference Example 4 | A | A | A | A | A | A | A | B | B |
| Comparative Example 1 | A | A | A | A | A | A | A | B | C |
| Comparative Example 2 | A | A | A | A | A | A | A | D | D |
| Comparative Example 3 | A | A | A | A | A | A | A | C | D |
| Comparative Example 4 | A | A | A | A | A | A | A | C | D |
| Comparative Example 5 | A | B | B | B | B | B | A | C | C |
| Comparative Example 6 | A | C | D | A | A | A | A | C | D |
| Comparative Example 7 | A | A | A | A | A | A | A | B | C |

TABLE 5

| 40° C./60% RH (High-temperature, high-humidity) | | | | | | | | | | | | | | |
|---|---|---|---|---|---|---|---|---|---|---|---|---|---|---|
| | | | Resolution | | | Transferability | | | Image density stability | | | Fogging | | |
| | Toner | Low-temperature fixability | Initial stage | After printing on 20,000 sheets | After printing on 40,000 sheets | Initial stage | After printing on 20,000 sheets | After printing on 40,000 sheets | Initial stage | After printing on 20,000 sheets | After printing on 40,000 sheets | Initial stage | After printing on 20,000 sheets | After printing on 40,000 sheets |
| Example 1 | A | A | A | A | A | A | A | A | A | A | A | A | A | A |
| Example 2 | B | A | A | A | A | A | A | A | A | A | A | A | A | A |
| Example 3 | C | A | A | A | A | A | A | A | A | A | A | A | A | A |
| Example 4 | D | A | A | A | A | A | A | A | A | A | A | A | B | C |
| Example 5 | E | A | A | A | A | A | A | A | A | A | A | A | A | A |
| Example 6 | F | A | A | A | A | A | A | A | A | B | B | A | A | A |
| Example 7 | G | A | A | A | A | A | A | A | A | A | A | A | B | B |
| Example 8 | H | A | A | A | A | A | A | A | A | A | A | A | A | A |
| Example 9 | I | A | A | A | A | A | A | A | A | A | A | A | B | C |
| Example 10 | J | A | A | A | A | A | A | A | A | A | A | A | A | A |
| Example 11 | K | A | A | A | A | A | A | A | A | A | A | A | A | A |
| Example 12 | L | A | A | A | A | A | A | A | A | A | A | A | A | A |
| Reference Example 1 | M | A | A | A | A | A | A | A | A | B | C | A | B | C |
| Example 14 | N | A | A | A | A | A | A | A | A | A | A | A | B | C |
| Reference Example 2 | O | A | A | A | A | A | A | A | A | A | B | A | C | C |
| Example 16 | P | A | A | A | A | A | A | A | A | A | B | A | A | A |
| Example 17 | Q | A | A | A | A | A | A | A | A | A | A | A | A | B |
| Example 18 | R | A | A | A | A | A | A | A | A | A | A | A | A | A |
| Example 19 | S | C | A | A | B | B | B | B | A | A | A | A | A | C |
| Example 20 | T | A | A | B | C | A | B | C | A | A | A | A | A | A |
| Example 21 | U | B | A | A | A | A | A | A | A | A | A | A | A | C |
| Reference Example 3 | V | B | A | A | A | A | A | A | A | A | A | A | C | C |
| Example 23 | W | A | A | A | C | A | B | C | A | A | A | A | A | A |
| Reference | X | A | A | B | C | A | B | C | A | A | C | A | A | A |

TABLE 5-continued

| | | | | | | | | | | | | | | |
|---|---|---|---|---|---|---|---|---|---|---|---|---|---|---|
| 40° C./60% RH (High-temperature, high-humidity) | | | | | | | | | | | | | | |
| Example 4 | | | | | | | | | | | | | | |
| Comparative Example 1 | a | A | A | A | A | A | A | A | A | A | B | A | C | D |
| Comparative Example 2 | b | — | — | — | — | — | — | — | — | — | — | — | — | — |
| Comparative Example 3 | c | — | — | — | — | — | — | — | — | — | — | — | — | — |
| Comparative Example 4 | d | — | — | — | — | — | — | — | — | — | — | — | — | — |
| Comparative Example 5 | e | B | A | A | A | A | A | A | A | B | B | A | C | D |
| Comparative Example 6 | f | — | — | — | — | — | — | — | — | — | — | — | — | — |
| Comparative Example 7 | g | A | A | A | A | A | A | A | A | A | A | A | C | D |

| | Development stripe | | | Gloss | | | Filming | | |
|---|---|---|---|---|---|---|---|---|---|
| | Initial stage | After printing on 20,000 sheets | After printing on 40,000 sheets | Initial stage | After printing on 20,000 sheets | After printing on 40,000 sheets | Initial stage | After printing on 20,000 sheets | After printing on 40,000 sheets |
| Example 1 | A | A | A | A | A | A | A | A | A |
| Example 2 | A | A | A | A | A | A | A | A | A |
| Example 3 | A | A | A | A | A | A | A | A | A |
| Example 4 | A | A | A | A | A | A | A | A | A |
| Example 5 | A | A | B | A | A | A | A | A | A |
| Example 6 | A | A | A | A | A | A | A | A | A |
| Example 7 | A | A | A | A | A | A | A | A | A |
| Example 8 | A | A | A | A | A | A | A | A | A |
| Example 9 | A | A | A | A | A | A | A | A | A |
| Example 10 | A | A | A | A | A | A | A | A | A |
| Example 11 | A | A | A | A | A | A | A | A | A |
| Example 12 | A | A | A | A | A | A | A | A | A |
| Reference Example 1 | A | A | A | A | A | A | A | A | A |
| Example 14 | A | A | A | A | A | A | A | A | A |
| Reference Example 2 | A | A | A | A | A | A | A | A | A |
| Example 16 | A | A | A | A | A | A | A | A | A |
| Example 17 | A | A | A | A | A | A | A | A | A |
| Example 18 | A | A | A | A | A | A | A | A | A |
| Example 19 | A | A | C | B | B | B | A | A | A |
| Example 20 | A | A | A | A | A | A | A | A | A |
| Example 21 | A | B | C | B | B | B | A | A | A |
| Reference Example 3 | A | B | C | B | B | B | A | A | A |
| Example 23 | A | A | A | A | A | A | A | A | A |
| Reference Example 4 | A | A | A | A | A | A | A | A | A |
| Comparative Example 1 | A | A | A | A | A | A | A | A | A |
| Comparative Example 2 | — | — | — | — | — | — | — | — | — |
| Comparative Example 3 | — | — | — | — | — | — | — | — | — |
| Comparative Example 4 | — | — | — | — | — | — | — | — | — |
| Comparative Example 5 | A | B | C | B | B | B | A | A | A |
| Comparative Example 6 | — | — | — | — | — | — | — | — | — |
| Comparative Example 7 | A | A | A | A | A | A | A | A | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-043773, filed Feb. 26, 2008, which is hereby incorporated by reference herein in its entirety.

The invention claimed is:

1. A toner comprising toner particles containing at least a binder resin and a colorant, and fatty acid metal salt particles, wherein the fatty acid metal salt particles have a volume-based median diameter (D50s) of 0.15 μm or more and 0.65 μm or less, a liberation ratio of the fatty acid metal salt particles in the toner is 1.0% or more and 25.0% or less, a content of the fatty acid metal salt particles is 0.02 part by mass or more and 0.50 part by mass or less with respect to 100 parts by mass of the toner particles, a Span value B of the fatty acid metal salt particles is 1.75 or less, where the Span value B is defined by the following equation (1):

$$\text{Span value } B=(D95s-D5s)/D50s \quad (1)$$

where D5s is the 5% accumulated diameter on a volume basis of the fatty acid metal salt, particles and D95s is the 95% accumulated diameter on a volume basis of the fatty acid metal salt particles, the toner has a ratio (Span value A/Span value B) of 0.25 or more and 0.75 or less where the Span value A is defined by the following equation (2):

$$\text{Span value } A=(D95t-D5t/D50t \quad (2)$$

where D5t is the 5% accumulated diameter on a number basis of the toner, D50t is the 50% accumulated diameter on a number basis of the toner, and D95t is the 95% accumulated diameter on a number basis of the toner, and the fatty acid metal salt particles comprise a metal stearate.

2. A toner according to claim 1, wherein the toner particles contain a wax component.

3. A toner according to claim 1, wherein the toner has a number average particle diameter (D1) of 3.0 μm or more and 8.0 μm or less, and in a case where, in a microcompression test on the toner, a maximum displacement ratio of one particle of the toner when a load of $9.8\times10^{-4}$N is applied to the particle at a loading rate of $9.8\times10^{-5}$N/sec is represented by $R_{100}$, and a displacement ratio of the particle at a load of $2.0\times10^{-4}$N is represented by $R_{20}$, $R_{100}$ and $R_{20}$ satisfy the following relationships:

$$0.20\leqq R_{100}\leqq 0.90$$

$$0.010\leqq R_{20}\leqq 0.080.$$

4. A toner according to claim 3, wherein, in the microcompression test on the toner, the following relationships are satisfied:

$$0.40\leqq R_{100}\leqq 0.80$$

$$0.020\leqq R_{20}\leqq 0.060.$$

5. A toner according to claim 1, wherein the toner has a viscosity at 100° C. of 8,000 Pa·s or more and 65,000 Pa·s or less.

6. A toner according to claim 1, wherein the fatty acid metal salt particles comprise zinc stearate particles or calcium stearate particles.

7. A toner according to claim 1, wherein the fatty acid metal salt particles contain a free fatty acid at a content of 0.20 mass % or less.

8. A toner according to claim 1, wherein the volume-based median diameter (D50s) of the fatty acid metal salt particles is 0.30 μm or more and 0.60 μm or less.

9. A toner according to claim 1, wherein the liberation ratio of the fatty acid metal salt particles is 2.0% or more and 20.0% or less.

10. A toner according to claim 1, wherein the toner has an average circularity of 0.940 or more and 0.990 or less.

11. A toner according to claim 1, wherein the toner particles have been produced by a suspension polymerization method.

* * * * *